US007249820B2

(12) United States Patent
Yoshida

(10) Patent No.: US 7,249,820 B2
(45) Date of Patent: Jul. 31, 2007

(54) PRINTING METHOD, PRINTING SYSTEM, PRINTING APPARATUS, PRINT-CONTROL METHOD, AND STORAGE MEDIUM

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 258 days.

(21) Appl. No.: 10/983,098

(22) Filed: Nov. 8, 2004

(65) Prior Publication Data

US 2005/0179711 A1 Aug. 18, 2005

(30) Foreign Application Priority Data

Nov. 7, 2003 (JP) ..... 2003-379000

(51) Int. Cl.
*B41J 29/393* (2006.01)

(52) U.S. Cl. ..... 347/19; 347/41; 347/15; 358/1.2

(58) Field of Classification Search ..... 347/19, 347/15, 41; 358/1.2
See application file for complete search history.

(56) References Cited

U.S. PATENT DOCUMENTS

| | | | | |
|---|---|---|---|---|
| 6,428,139 | B1 * | 8/2002 | Silverbrook | 347/19 |
| 6,565,180 | B2 * | 5/2003 | Yu et al. | 347/19 |
| 6,764,156 | B2 * | 7/2004 | Mantell | 347/14 |

FOREIGN PATENT DOCUMENTS

| | | | |
|---|---|---|---|
| JP | 2-54676 | A | 2/1990 |
| JP | 6-166247 | A | 6/1994 |
| JP | 2001-105578 | A | 4/2001 |

* cited by examiner

*Primary Examiner*—Lamson Nguyen
(74) *Attorney, Agent, or Firm*—Sughrue Mion, PLLC

(57) ABSTRACT

The present invention relates to a printing method for printing, on a medium, an image constituted by a plurality of dot lines, including the following steps of: storing characteristic values, each corresponding to different nozzles; calculating a correction value based on at least two of the characteristic values which correspond to at least two of the nozzles that form a given dot line; converting image data corresponding to that dot line into print data in accordance with the correction value; and forming the dot line with the at least two nozzles by ejecting ink in accordance with the print data from the nozzles which move in a movement direction.

19 Claims, 23 Drawing Sheets

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

Fig.6A

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

Fig.6B

| nozzle number | characteristic value(%) |
|---|---|
| #1 | +2.0 |
| #2 | +1.5 |
| #3 | −0.5 |
| #4 | 0 |
| #5 | +0.5 |
| #6 | −1.0 |
| #7 | −1.5 |
| #8 | −0.5 |
| #9 | +0.5 |
| #10 | 0 |
| #11 | +1.0 |
| #12 | +1.5 |

Fig.23

PRINTING METHOD, PRINTING SYSTEM, PRINTING APPARATUS, PRINT-CONTROL METHOD, AND STORAGE MEDIUM

CROSS-REFERENCE TO RELATED APPLICATIONS

The present application claims priority upon Japanese Patent Application No. 2003-379000 filed on Nov. 7, 2003, which is herein incorporated by reference.

FIELD OF THE INVENTION

The present invention relates to printing systems, printing apparatuses, print-control methods, and storage media.

DESCRIPTION OF THE RELATED ART

Printing systems provided with an inkjet printer and a computer on which a printer driver is installed are well known. Such inkjet printers are provided with a plurality of nozzles which are movable in a movement direction. Meanwhile, the printer driver converts image data created with an application software or the like into print data. The printing apparatus forms dots on a paper by ejecting ink from the moving nozzles in accordance with the print data received from the printer driver, forms dot lines using the plurality of dots lining up in the movement direction, and thereby prints an image on the paper using the plurality of dot lines.

The nozzles of the inkjet printer have different ink ejection characteristics, due to such influences as manufacturing errors. Due to the influence of discrepancies among the individual ink ejection characteristics, the image quality of images printed on paper may deteriorate. To address this, it has been proposed to employ a correction value for each nozzle (see JP 6-166247A).

SUMMARY OF THE INVENTION

It is an object of the present invention to convert the image data into print data in accordance with the nozzle characteristics, and to improve the image quality of printed images. It is a further object of the present invention to reduce the calculation load when converting the image data into print data in accordance with the nozzle characteristics in a case where one raster line is formed by two or more nozzles.

A main aspect of the present invention for attaining the above-noted objects is a printing method for printing an image on a medium comprising the following steps.

A printing method for printing on a medium an image constituted by a plurality of dot lines, comprises the following steps of:

storing characteristic values, each corresponding to different nozzles;

calculating a correction value based on at least two of the characteristic values which correspond to at least two of the nozzles that form a given dot line;

converting image data corresponding to that dot line into print data in accordance with the correction value; and forming the dot line with the at least two nozzles by ejecting ink in accordance with the print data from the nozzles which move in a movement direction.

Other features and objects of the present invention shall become clear upon reading the present specification in conjunction with the accompanying drawings.

BRIEF DESCRIPTION OF THE DRAWINGS

FIG. 6A is a dither matrix used in the determination for large dots, and FIG. 6B is a dither matrix used in the determination for medium dots.

FIG. 23 is an explanatory diagram of the table stored in the printer's memory.

Figure 1:
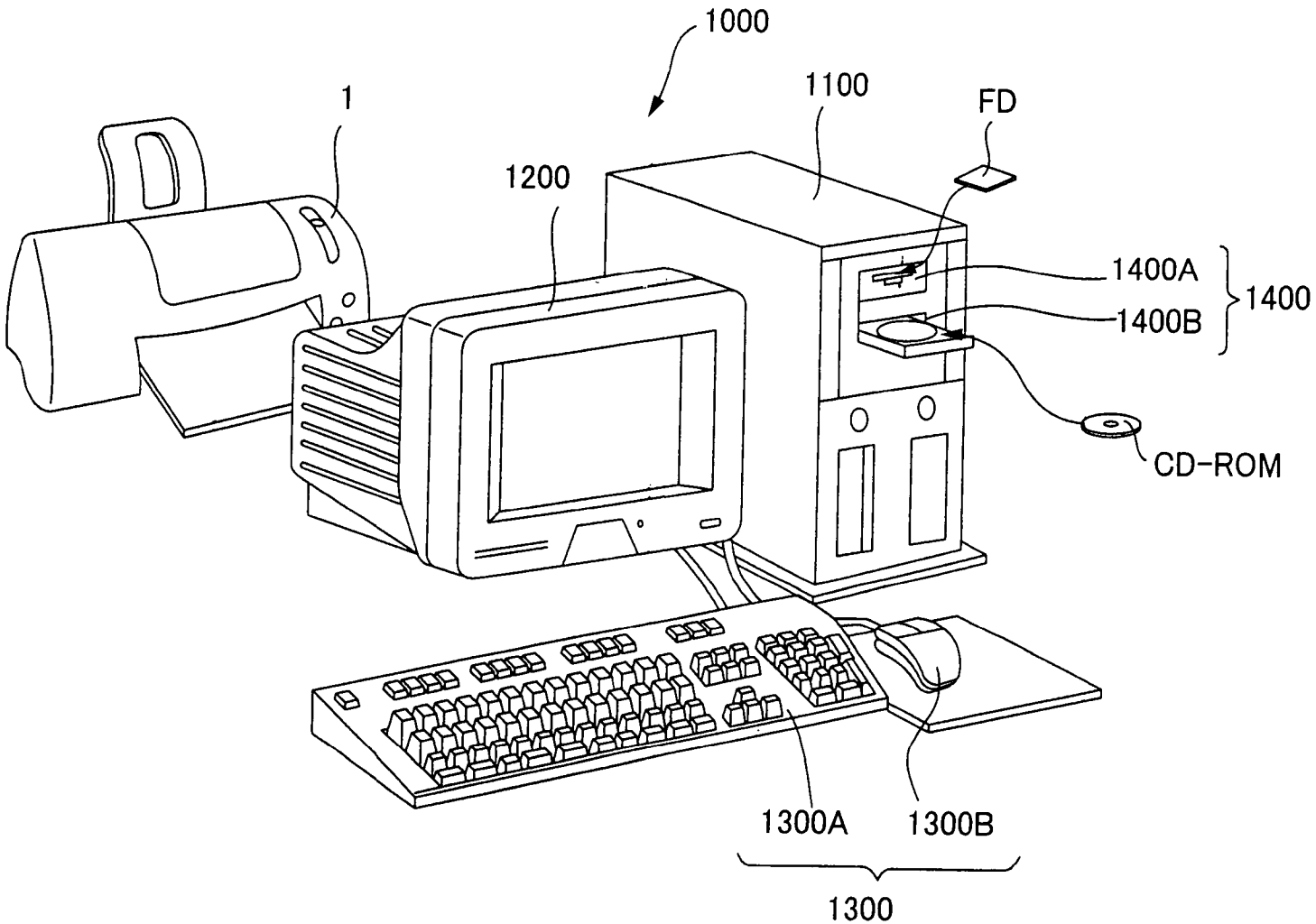
FIG. 1 is an explanatory diagram of an overall configuration of a printing system.

In order to facilitate a more complete understanding of the present invention and the advantages thereof, reference is now made to the following description taken in conjunction with the accompanying drawings.

DESCRIPTION OF THE PREFERRED EMBODIMENTS

Overview of the Disclosure

At least the following matters should become clear from the disclosure of the present specification and the accompanying drawings.

A printing method for printing on a medium an image constituted by a plurality of dot lines, comprises the following steps of:

storing characteristic values, each corresponding to different nozzles;

calculating a correction value based on at least two of the characteristic values which correspond to at least two of the nozzles that form a given dot line;

converting image data corresponding to that dot line into print data in accordance with the correction value; and forming the dot line with the at least two nozzles by ejecting ink in accordance with the print data from the nozzles which move in a movement direction.

In this way, the image quality of the printed image can be improved, and the calculation load when converting the image data into print data in accordance with the nozzle characteristics can be reduced.

In the above printing method, it is preferable that a halftone process is performed in accordance with the correction value, and in the halftone process, multi-gradation image data is converted into image data having a lower number of gradations than the multi-gradation image data when converting the image data into the print data. In this way, a halftone process can be performed in consideration of the nozzle characteristics. Moreover, it is preferable that a creation ratio table for determining a creation ratio of dots is corrected in accordance with the correction value; and that the halftone process is performed in accordance with the corrected creation ratio table. In this way, image data can be created in expectation of the influence of the nozzle characteristics. Moreover, it is preferable that an amount of ink that is ejected into a plurality of pixels within a predetermined region expresses a darkness of the image in that region. In this way, the configuration of the nozzles can be simplified, and the apparatus can be provided at low cost. Moreover, it is preferable that dithering is used for the halftone process. In this way, it is possible to express the darkness of the printed image within a predetermined region including a plurality of pixels.

In the above printing method, it is preferable that a color conversion process is performed in accordance with the correction value, and in the color conversion process, image data in the RGB color space is converted into image data in the CMYK color space when converting the image data into the print data. In this way, the color conversion process can be performed in consideration of the nozzle characteristics. Moreover, it is preferable that a color conversion table for converting the image data in the RGB color space into the image data in the CMYK color space is corrected in accordance with the correction value; and the color conversion process is performed in accordance with the corrected color conversion table. Thus, it is possible to create image data in expectation of the influence of the nozzle characteristics.

In the above printing method, it is preferable that a resolution conversion process is performed when converting the image data into the print data, and the calculation of the correction value is carried out after the resolution conversion process. In this way, it is easy to specify the image data (pixel data) corresponding to a predetermined raster line of the printed image.

In the above printing method, it is preferable that information regarding the characteristic values that are stored in a printing apparatus are sent to a control apparatus that converts the image data into the print data. In this way, it is possible to use the characteristic values corresponding to the nozzles when the control apparatus converts the image data into print data.

In the above printing method, it is preferable that the nozzles that form the dot line are determined in accordance with a print mode. This is because, if the print mode is known, then the carry amount etc. are known as well, so that it can be determined which raster line is formed by which nozzles.

In the above printing method, it is preferable that a test pattern for inspecting ejection characteristics of the nozzles is printed. In this way, the ejection characteristics of the nozzles can be inspected. Moreover, in this printing method, it is preferable that the characteristic values of the nozzles are stored in accordance with the result of inspecting the test pattern. In this way, the characteristic value of each nozzle can be determined.

In the above printing method, it is preferable that the dots constituting the dot line each has a shape of an ellipse with a major axis in the movement direction. In this way, if the print data is created using the above-noted correction value, then the overall darkness of the raster lines of the printed image better approaches the darkness expressed by the image data.

In the above printing method, it is preferable that, if one of the nozzles that form the dot line has a characteristic of ejecting a smaller amount of ink than a reference nozzle serving as a reference, then the image data is converted into the print data such that the amount of ink that is ejected from that nozzle when forming the dot line becomes larger than the amount of ink that is ejected from the reference nozzle when forming the dot line. The nozzles having a comparatively small ink ejection amount form dots whose darkness is lighter than that formed by regular nozzles. Therefore, if a little more ink is ejected when forming the printed image with these nozzles, then it is possible to form a printed image of the same darkness as the printed image formed with the regular nozzles.

A printing system comprises:

a control apparatus that converts image data into print data; and a printing apparatus that has a plurality of nozzles that are movable in a movement direction, and that prints on a medium an image constituted by a plurality of dot lines by ejecting ink from the plurality of nozzles in accordance with the print data;

wherein the printing apparatus stores characteristic values each corresponding to the respective nozzles;

wherein the control apparatus calculates a correction value based on at least two of the characteristic values which correspond to at least two of the nozzles that form a given dot line;

wherein the control apparatus converts the image data corresponding to that dot line into print data in accordance with the correction value; and wherein the printing apparatus forms the dot line with the at least two nozzles by ejecting ink from the nozzles, which move in the movement direction, in accordance with the print data.

In this way, the image quality of the printed image can be improved, and the calculation load when converting the image data into print data in accordance with the nozzle characteristics can be reduced.

A printing apparatus for printing on a medium an image constituted by a plurality of dot lines, comprises:

a plurality of nozzles that are movable in a movement direction;

a memory that stores characteristic values each corresponding to the respective nozzles; and a controller that calculates a correction value based on at least two of the characteristic values which correspond to at least two of the nozzles that form a given dot line;

converts image data corresponding to that dot line into print data in accordance with the correction value; and forms the dot line with the at least two nozzles by causing ink to be ejected in accordance with the print data from the nozzles which move in the movement direction.

In this way, the image quality of the printed image can be improved, and the calculation load when converting the image data into print data in accordance with the nozzle characteristics can be reduced.

A print-control method for controlling a printing apparatus that prints on a medium an image constituted by a plurality of dot lines, comprises:

storing characteristic values, each corresponding to different nozzles;

calculating a correction value based on at least two of the characteristic values which correspond to at least two of the nozzles that form a given dot line;

converting image data corresponding to that dot line into print data in accordance with the correction value; and sending the print data to the printing apparatus and causing the dot line to be formed with the at least two nozzles by causing ink to be ejected in accordance with the print data from the nozzles which move in a movement direction.

In this way, the image quality of the printed image can be improved, and the calculation load when converting the image data into print data in accordance with the nozzle characteristics can be reduced.

A computer-readable storage medium comprises:

a memory for storing a program, the program causing a print-control apparatus for controlling a printing apparatus that prints on a medium an image constituted by a plurality of dot lines, to:

store characteristic values, each corresponding to different nozzles;

calculate a correction value based on at least two of the characteristic values which correspond to at least two of the nozzles that form a given dot line;

convert image data corresponding to that dot line into print data in accordance with the correction value; and send the print data to the printing apparatus to cause the printing apparatus to form the dot line with the at least two nozzles by ejecting ink in accordance with the print data from the nozzles which move in a movement direction.

In this way, the image quality of the printed image can be improved, and the calculation load when converting the image data into print data in accordance with the nozzle characteristics can be reduced.

Configuration of the Printing System

An embodiment of a printing system is described next with reference to the drawings.

FIG. 1 is an explanatory diagram showing the external structure of the printing system. A printing system 1000 is provided with a printer 1, a computer 1100, a display device 1200, an input device 1300, and a record/play device 1400. The printer 1 is a printing apparatus for printing images on a medium such as paper, cloth, or film. The computer 1100 is communicably connected to the printer 1, and outputs print data corresponding to an image to be printed to the printer 1 in order to print the image with the printer 1. The display device 1200 has a display, and displays a user interface of, for example, an application program or a printer driver 1110 (see FIG. 2). The input device 1300 is for example a keyboard 1300A and a mouse 1300B, and is used to operate the application program or adjust the settings of the printer driver 1110, for example, through the user interface that is displayed on the display device 1200. A flexible disk drive 1400A and a CD-ROM drive 1400B are employed as the record/play device 1400, for example.

The printer driver 1110 is installed on the computer 1100. The printer driver 1110 is a program for achieving the function of displaying the user interface on the display device 1200, and the function of converting image data that has been output from the application program into print data. The printer driver 1110 is recorded on a recording medium (computer-readable storage medium) such as a flexible disk FD or a CD-ROM. Also, the printer driver 1110 can be downloaded onto the computer 1100 via the Internet. It should be noted that this program is made of codes for achieving various functions.

It should be noted that "printing apparatus" in a narrow sense means the printer 1, but in a broader sense it means the system constituted by the printer 1 and the computer 1100.

Printer Driver

<Regarding the Printer Driver>

Figure 2:
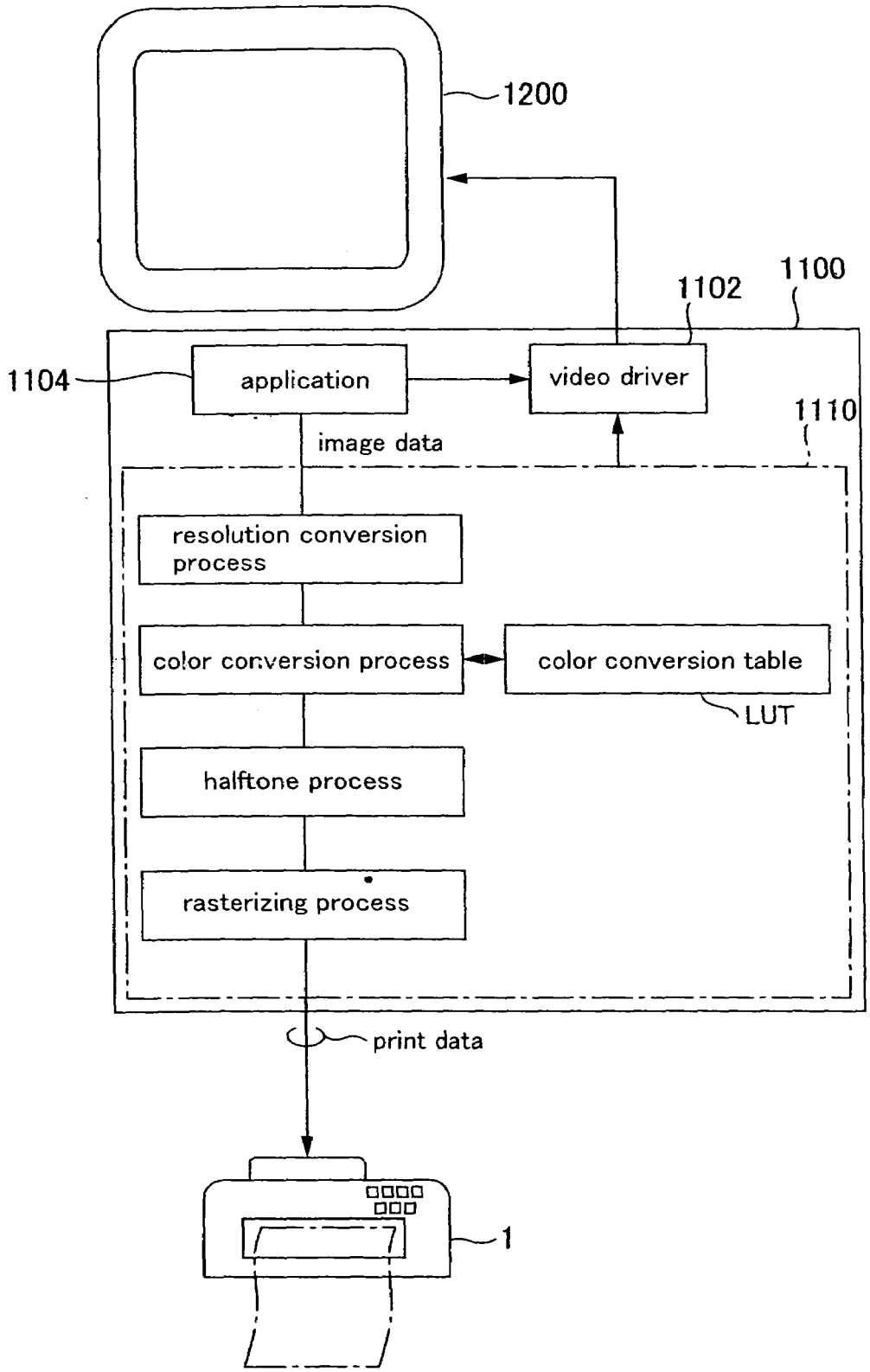
FIG. 2 is an explanatory diagram of processes carried out by a printer driver.

FIG. 2 is a schematic explanatory diagram of the basic processes carried out by the printer driver 1110. Structural elements that have already been described are assigned identical reference numerals and thus their further description is omitted.

On the computer 1100, computer programs such as a video driver 1102, an application program 1104, and a printer driver 1110 operate under an operating system installed on the computer. The video driver 1102 has the function of displaying, for example, the user interface on the display device 1200 in accordance with display commands from the application program 1104 and the printer driver 1110. The application program 1104, for example, has a function such as enabling image editing and creates data related to an image (image data). A user can give an instruction to print an image edited in the application program 1104 via the user interface of the application program 1104. Upon receiving the print instruction, the application program 1104 outputs the image data to the printer driver 1110.

The printer driver 1110 receives the image data from the application program 1104, converts the image data into print data, and outputs the print data to the printer 1. The image data has pixel data as the data about the pixels of the image to be printed. The gradation values etc. of the pixel data are then converted in accordance with the later-described processing stages, and are ultimately converted at the print data stage into data about the dots to be formed on the paper (data such as the color and the size of the dots). It should be noted that "pixels" are virtual squares on the paper that define the positions onto which ink lands to form dots.

Print data is data in a format that can be interpreted by the printer 1, and includes the pixel data and various command data. Here, "command data" refers to data for instructing the printer 1 to carry out a specific operation, and is data indicating the carry amount, for example.

In order to convert the image data that is output from the application program 1104 into print data, the printer driver 1110 carries out such processes as resolution conversion, color conversion, halftoning, and rasterization. The following is a description of the processes carried out by the printer driver 1110.

Resolution conversion is a process for converting image data (text data, image data, etc.) output from the application program 1104 to the resolution for printing an image on paper (the spacing between dots when printing; also referred to as "print resolution"). For example, when the print resolution has been designated as 720×720 dpi, then the image data obtained from the application program 1104 is converted into image data having a resolution of 720×720 dpi.

In this conversion method, if the resolution of the image data is lower than the designated print resolution, then new pixel data is generated between adjacent pixel data by linear interpolation, whereas if the resolution is higher than the designated print resolution, then pixel data is thinned out at a constant ratio, thus adjusting the resolution of the image data to the print resolution.

Also, in this resolution conversion process, the size of the print region, which is the region onto which ink is actually ejected, is adjusted based on the image data. This size adjustment is performed, for example, by trimming the pixel data, of the image data, that correspond to the edges of the paper, in accordance with the margin format mode, the image quality mode, and the paper size mode, which are described later.

It should be noted that the pixel data in the image data has a gradation value in many levels (for example, 256 levels) expressed in RGB color space. The pixel data having such a RGB gradation value is hereinafter referred to as "RGB pixel data," and the image data made of these RGB pixel data is referred to as "RGB image data."

Color conversion processing is processing for converting the RGB pixel data of the RGB image data into data having a gradation value in many levels (for example, 256 levels) expressed in CMYK color space. C, M, Y and K are the ink colors of the printer 1. Hereinafter, the pixel data having such a CMYK gradation value is referred to as CMYK pixel data, and the image data made of these CMYK pixel data is referred to as CMYK image data. Color conversion processing is carried out by the printer driver 1110, with reference to a table (color conversion lookup table LUT) that correlates RGB gradation values and CMYK gradation values.

Halftone processing is processing for converting CMYK pixel data having a gradation value in a higher level into CMYK pixel data having a gradation value in a lower level, which can be expressed by the printer 1. For example, through halftone processing, CMYK pixel data representing gradation values in 256 levels is converted into 2-bit CMYK pixel data representing gradation values in four levels. The 2-bit data CMYK pixel data indicates, for example, "no dot formation" "small dot formation," "medium dot formation," and "large dot formation" for each color.

Dithering or the like is used for such a halftone processing to create 2-bit CMYK pixel data with which the printer 1 can form dots dispersedly. Halftone processing through dithering is described later. It should be noted that the method used for halftone processing is not limited to dithering, and it is also possible to use γ-correction or error diffusion or the like.

Rasterization is processing for changing the CMYK image data that has been subjected to halftone processing into the data order in which they are to be transferred to the printer 1. Data that has been rasterized are output to the printer 1 as print data.

<Halftone Processing Through Dithering>

Figure 3:
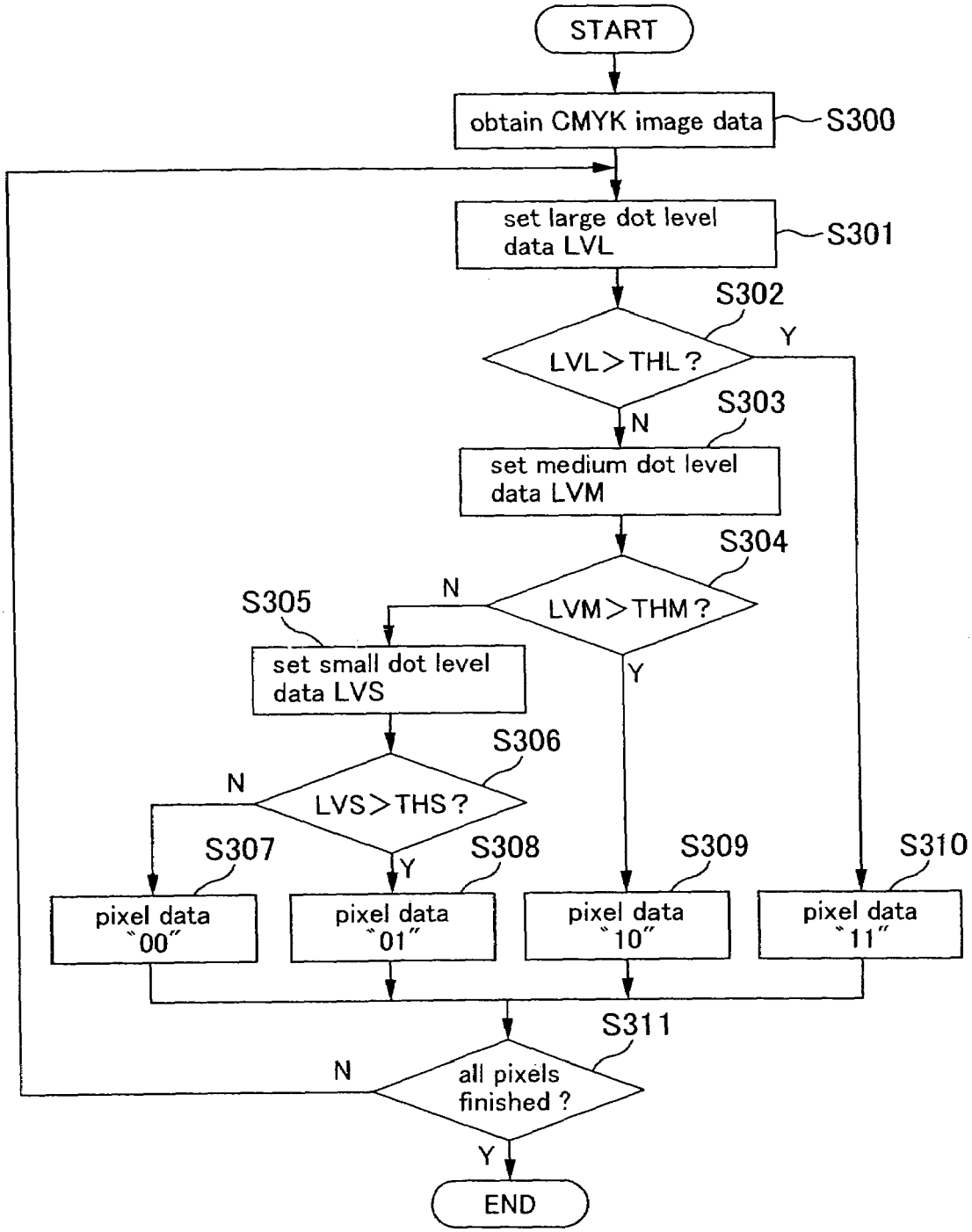
FIG. 3 is a flowchart of halftone processing through dithering.

Here, halftone processing through dithering is described in more detail. FIG. 3 is a flowchart of halftone processing through dithering. The following steps are executed in accordance with this flowchart.

First, in step S300, the printer driver 1110 obtains the CMYK image data. The CMYK image data is made of image data expressed by gradation values in 256 levels for each ink color C, M, Y, and K. In other words, the CMYK image data includes C image data for cyan (C), M image data for magenta (M), Y image data for yellow (Y), and image data for black (K). Each of the C, M, Y, and K image data is respectively made of C, M, Y, and K pixel data indicating the gradation values of that ink color. It should be noted that the following description can be applied to any of the C, M, Y, and K image data, and thus the K image data is described as an example.

The printer driver 1110 performs the processing of the steps S301 to S311 for all of the K pixel data in the K image data while successively changing the K image data to be processed, and converts each of the K image data into 2-bit data representing one of "no dot formation," "small dot formation," "medium dot formation" and "large dot formation" mentioned above.

Figure 4:
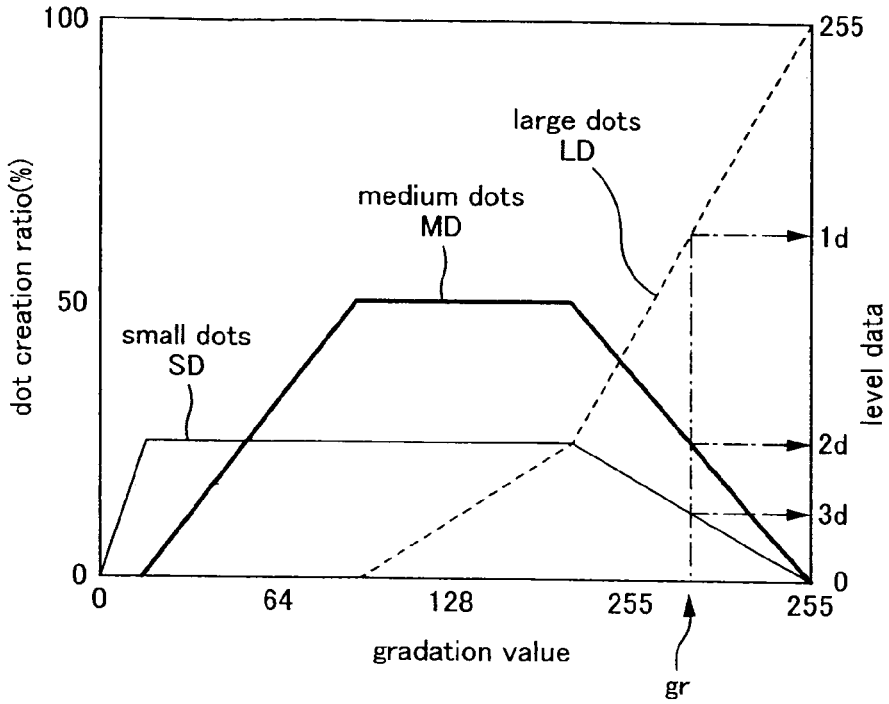
FIG. 4 is a diagram showing a dot creation ratio table.

More specifically, first, in step S301, the large dot level data LVL is set as follows in accordance with the gradation value of the K pixel data being processed. FIG. 4 is a diagram showing a creation ratio table that is used for setting the level data for large, medium, and small dots. The horizontal axis in this diagram is the gradation value (0–255), the vertical axis on the left is the dot creation ratio (%), and the vertical axis on right is the level data (0–255). Here, the "dot creation ratio" means the proportion of pixels in which dots are formed among all the pixels in a uniform region reproduced with a constant gradation value. The profile SD shown by the thin solid line in FIG. 4 indicates the creation ratio of small dots, the profile MD shown by the thick solid line indicates the creation ratio of medium dots, and the profile LD shown by the dashed line indicates the creation ratio of large dots. Moreover, "level data" refers to data that is obtained by converting the dot creation ratio into 256 levels ranging from 0 to 255.

That is to say, in step S301, the level data LVL corresponding to the gradation value is read from the profile LD for large dots. For example, as shown in FIG. 4, if the gradation value of the K pixel data to be processed is gr, then the level data LVL is determined to be 1*d* using the profile LD. In practice, the profile LD is stored in the form of a one-dimensional table in a memory (not shown) such as a ROM within the computer 1100, and the printer driver 1110 determines the level data by referencing this table.

In step S302, it is then determined whether or not the level data LVL that has been set in this way is larger than a threshold value THL. Here, determination of whether the dots are on or off is performed using dithering. The threshold value THL is set to a different value for each pixel block of a so-called dither matrix. This embodiment uses a matrix in which the values from 0 to 254 appear in the fields of 16×16 square pixel blocks.

Figure 5:
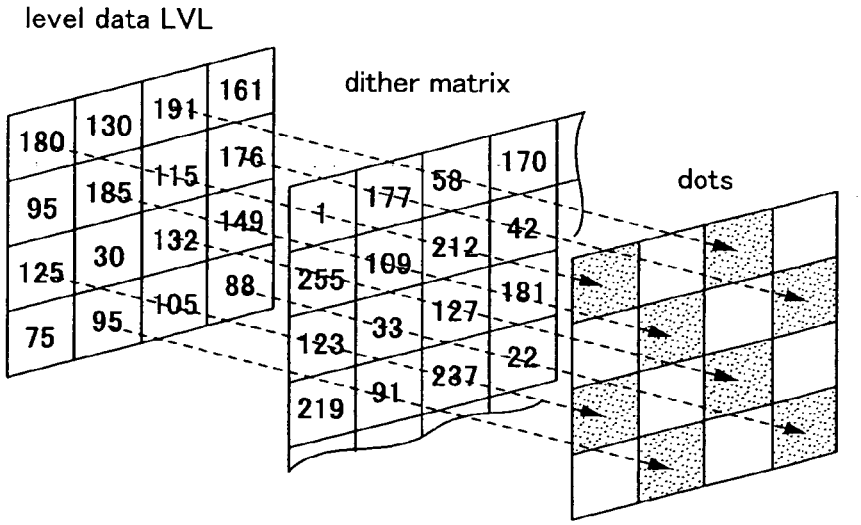
FIG. 5 is a diagram that shows how dots are to be judged on or off according to dithering.

FIG. 5 is a diagram that shows how dots are to be judged on or off according to dithering. For the convenience of illustration, FIG. 5 shows only some of the K pixel data. First, as shown in the figure, the level data LVL of each of the K pixel data is compared with the threshold value THL of the pixel block on the dither matrix that corresponds to that K pixel data.

Then, if the level data LVL is larger than the threshold value THL, the dot is set to on, and if the level data LVL is smaller, the dot is set to off. The pixel data shown hatched in the figure indicates K pixels in which the dot is set to on. In other words, in step S302, if the level data LVL is larger than the threshold value THL, then the procedure advances to step S310, and otherwise the procedure advances to step S303. Here, if the procedure advances to step S310, then the printer driver 1110 assigns a binary value "11" indicative of a large dot to the K pixel data being processed and stores this value, and then the procedure advances to step S311. Then, in step S311, it is determined whether or not all of the K pixel data has been processed. If the processing is finished, then the halftone processing is ended, and if processing is not finished, then the processing shifts to K pixel data that has not yet been processed, and the procedure returns to step S301.

On the other hand, if the procedure advances to step S303, then the printer driver 1110 sets the level data LVM for medium dots. The level data LVM for medium dots is set by the creation ratio table noted above, based on the gradation value. The setting method is the same as for setting the level data LVL of large dots. That is to say, in the example shown in FIG. 4, the level data LVM is determined to be 2*d*.

Then, in Step S304, it is judged whether the medium dots are on or off by comparing the level data LVM of the medium dots with the threshold value THM. The method for determining whether the dots are on or off is the same as that for the large dots, however, as shown next, the threshold value THM that is used in the judgment is a value that is different from the threshold value THL used in the case of the large dots. That is, if the dots are determined to be on or off using the same dither matrix for the large dots and the medium dots, then the pixel blocks where the dots are likely to be on will be the same in both cases. That is, there is a high possibility that when a large dot is off, the medium dot will also be off. As a result, there is a risk that the creation ratio of medium dots will be lower than the desired creation ratio. In order to avert this problem, in the present embodiment, different dither matrixes are used for the two. That is, by changing the pixel blocks that tend to be on for the large dots and the medium dots, it is possible to ensure that the large dots and the medium dots are formed appropriately.

FIG. 6A and FIG. 6B show the relationship between the dither matrix that is used for assessing large dots and the dither matrix that is used for assessing medium dots. In this embodiment, a first dither matrix TM as shown in FIG. 6A is used for the large dots, and a second dither matrix UM as shown in FIG. 6B, which is obtained by mirroring these threshold values symmetrically at the center in the carrying direction, is used for the medium dots. As explained previously, the present embodiment uses a 16×16 matrix, but for convenience of illustration, FIG. 6 shows a 4×4 matrix. It should be noted that it is also possible to use large dot dither matrixes and medium dot dither matrixes that are completely different.

Then, in step S304, if the medium dot level data LVM is larger than the medium dot threshold value THM, then it is determined that the medium dot should be on, and the procedure advances to step S309, and otherwise the procedure advances to step S305. Here, if the procedure advances to step S309, then the printer driver 1110 assigns the binary value "10" indicating that the pixel data represent a medium dot to the K pixel data being processed and stores this value, and then the procedure advances to step S311. Then, in step S311, it is determined whether or not all of the K pixel data has been processed. If the processing is finished, then the halftone processing is ended, and if processing is not finished, then the processing shifts to K pixel data that has not yet been processed, and the procedure returns to step S301.

On the other hand, if the procedure advances to step S305, then the small dot level data LVS is set in the same way that the level data of the large dots and the medium dots are set. It should be noted that the dither matrix for the small dots is preferably different from those for the medium dots and the large dots, in order to prevent a drop in the creation ratio of small dots as discussed above.

In step S306, if the level data LVS is larger than the threshold value THS for small dots, then the printer driver 1110 advances to step S308, and otherwise it advances to step S307. Here, if the procedure advances to step S308, then a binary value "01" for pixel data that indicate a small dot is assigned to the K pixel data being processed and this value is stored, and then the procedure advances to step S311. Then, in step S311, it is determined whether or not all of the K pixel data has been processed, and if processing is not finished, then the processing shifts to K pixel data that has not yet been processed, and the procedure returns to step S301. On the other hand, if processing is finished, then halftone processing for the K image data is ended, and halftone processing is performed in the same manner for the image data of the other colors.

If, on the other hand, the procedure has advanced to step S307, then the printer driver 1110 assigns a binary value "00" indicating that no dot is to be formed with respect to the K pixel data being processed and stores this value. Then the procedure advances to step S311. Then, in step S311, it is determined whether or not all of the K pixel data has been processed. If processing is not finished, then the processing shifts to K pixel data that has not yet been processed, and the procedure returns to step S301. On the other hand, if processing is finished, then halftone processing for the K image data is ended, and halftone processing is performed in the same way for the image data of the other colors.

<Regarding the Settings of the Printer Driver>

Figure 7:
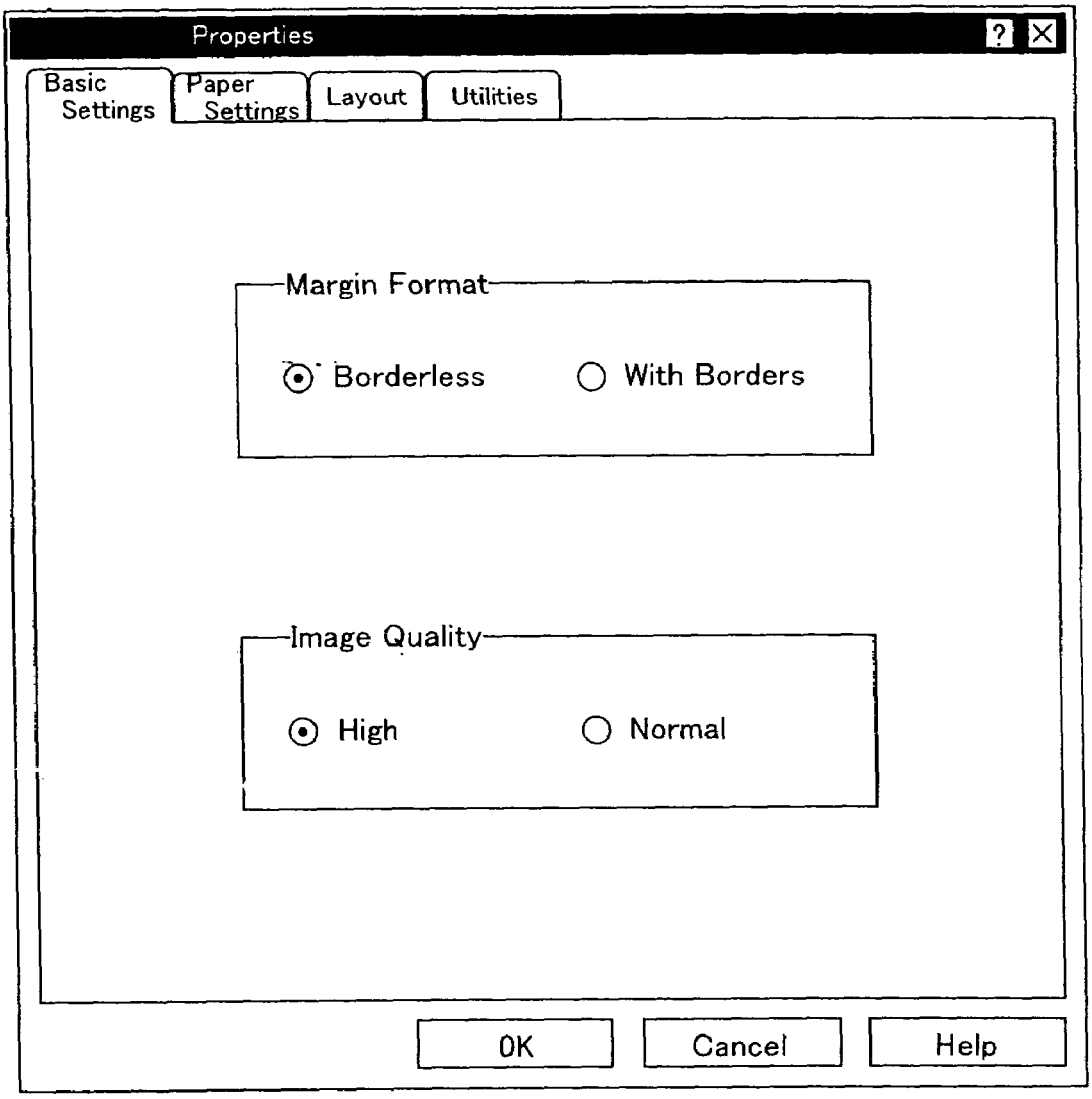
FIG. 7 is an explanatory diagram of a user interface of the printer driver.

FIG. 7 is an explanatory diagram of the user interface of the printer driver 1110. The user interface of the printer driver 1110 is displayed on a display device via the video driver 1102. The user can use the input device 1300 to change the various settings of the printer driver 1110. The settings for margin format mode and image quality mode are prearranged as the basic settings, and settings such as paper size mode are prearranged as the paper settings. These modes are described later.

Configuration of the Printer

<Regarding the Configuration of the Inkjet Printer>

Figure 8:
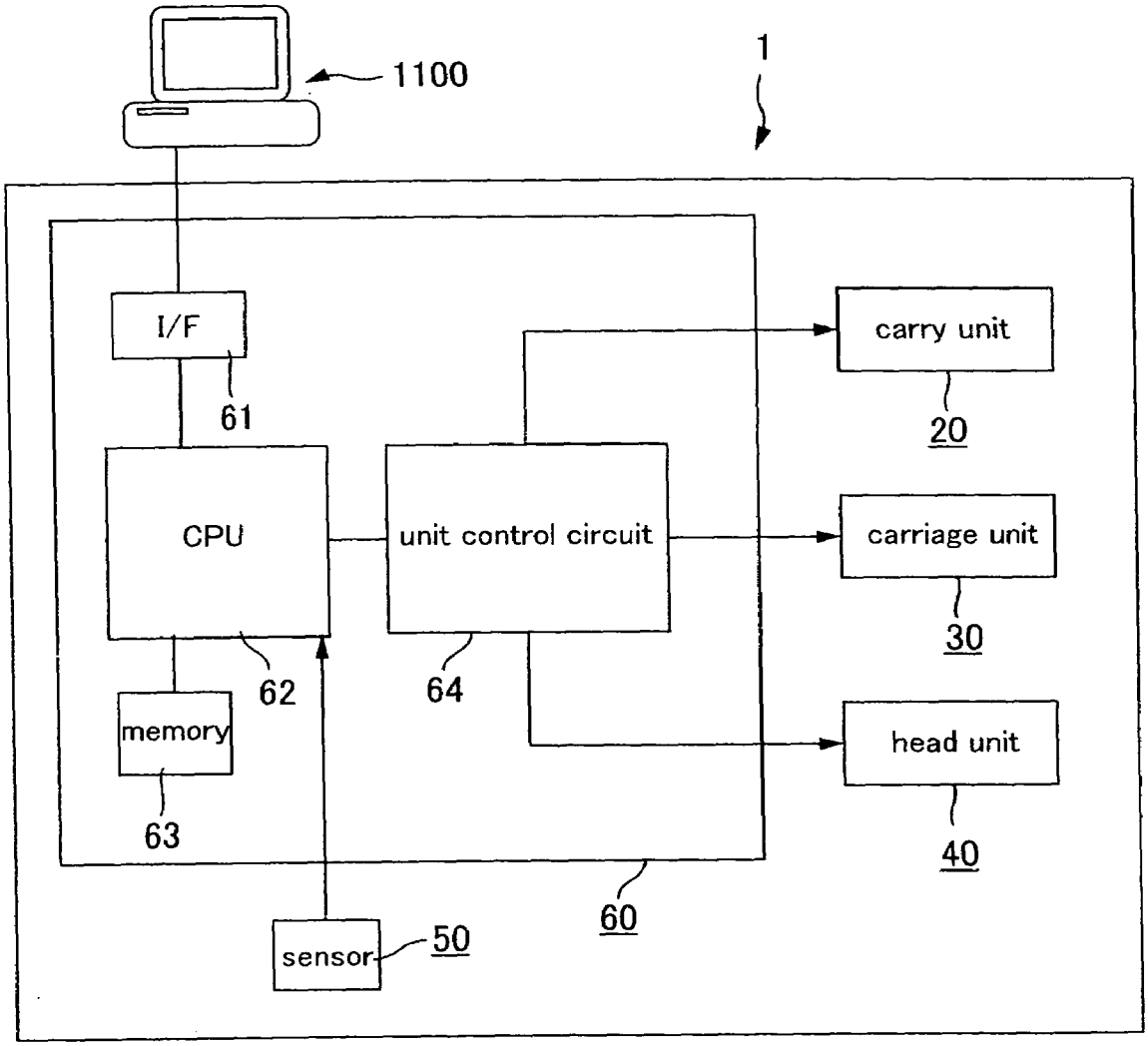
FIG. 8 is a block diagram of an overall configuration of a printer.
Figure 9:
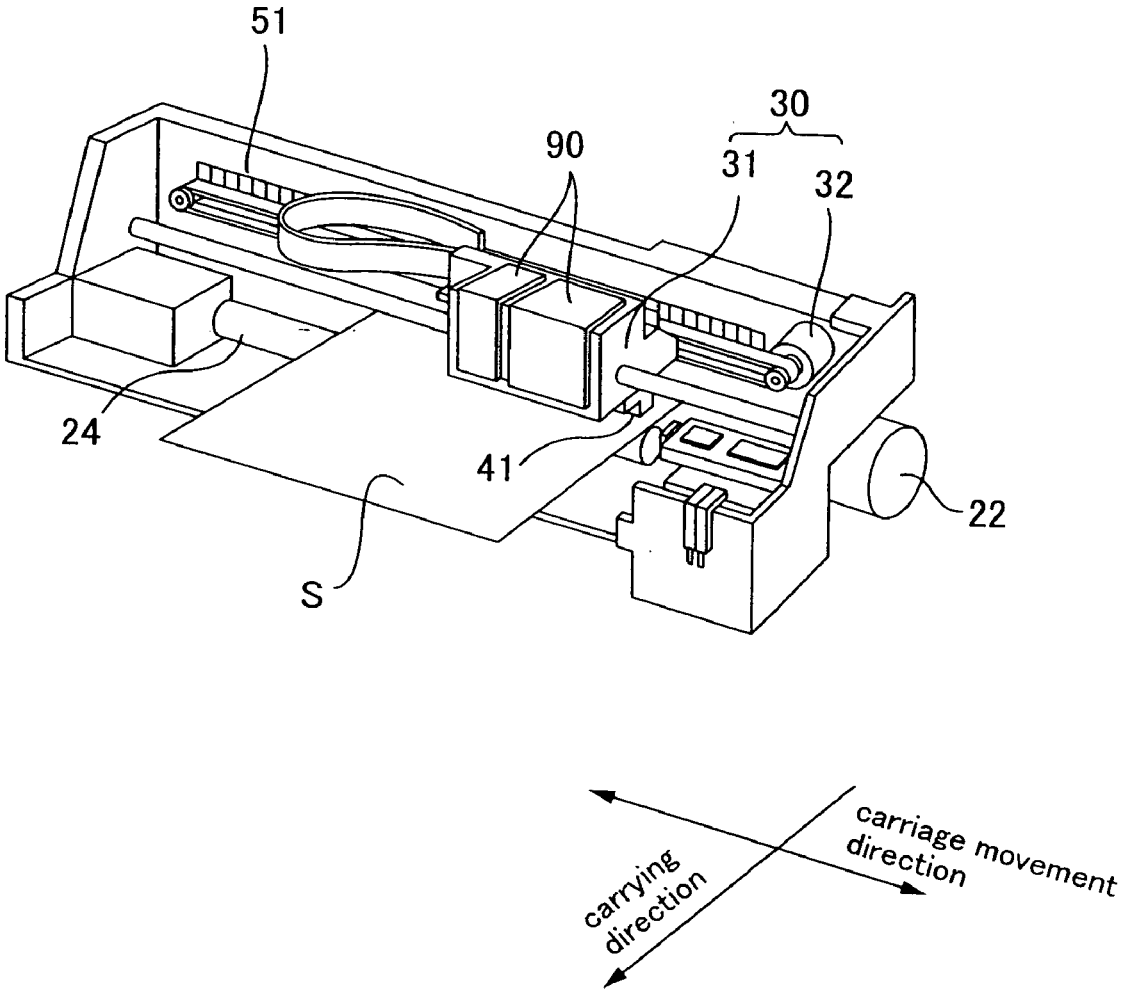
FIG. 9 is a schematic diagram of the overall configuration of the printer.
Figure 10:
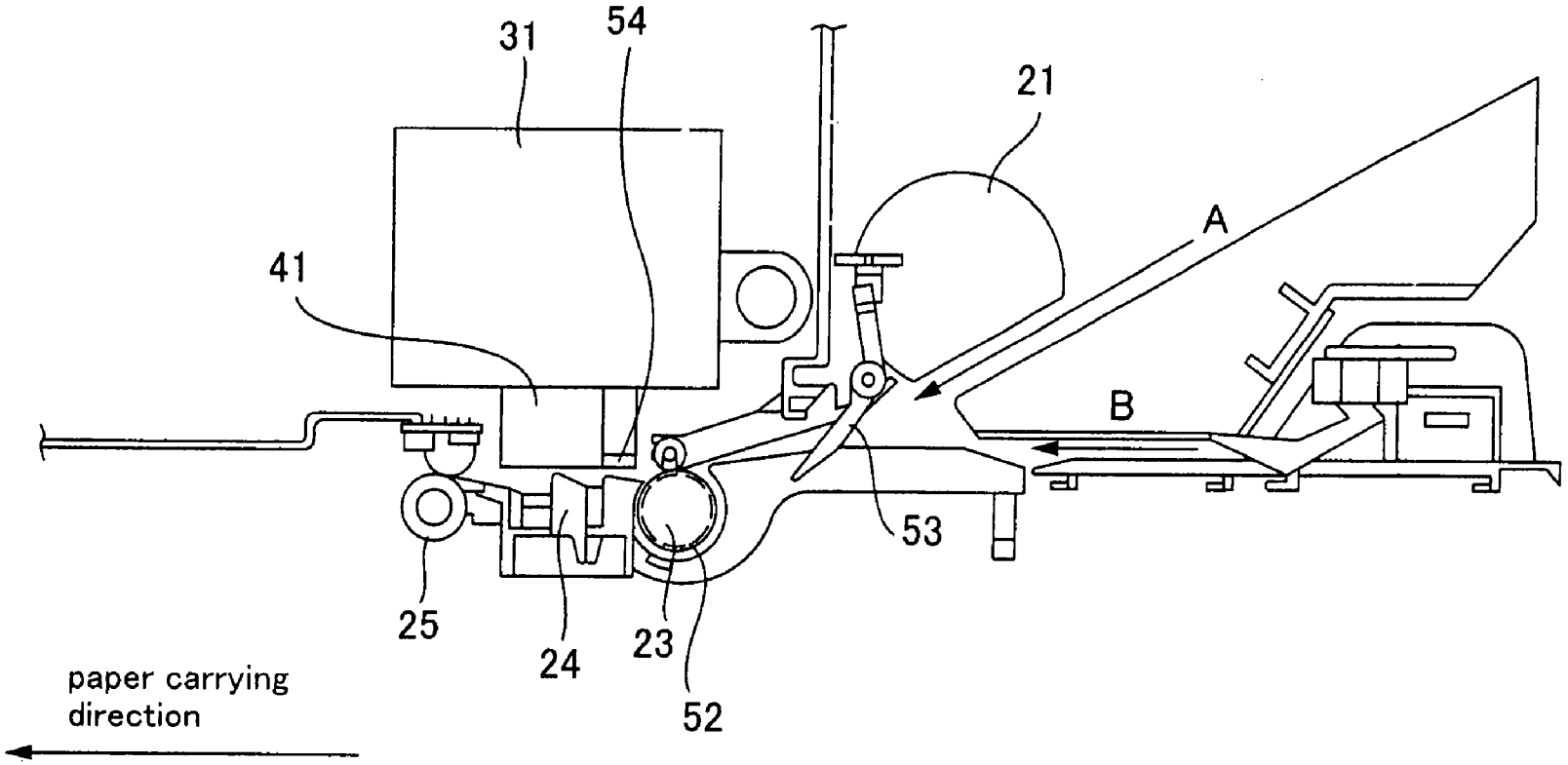
FIG. 10 is a transverse sectional view of the overall configuration of the printer.

FIG. 8 is a block diagram of the overall configuration of the printer of this embodiment. Also, FIG. 9 is a schematic diagram of the overall configuration of the printer of this embodiment. FIG. 10 is lateral sectional view of the overall configuration of the printer of this embodiment. The basic structure of the printer according to the present embodiment is described below.

The inkjet printer 1 of this embodiment has a carry unit 20, a carriage unit 30, a head unit 40, a sensor 50, and a controller 60. The printer 1, which receives print data from the computer 110, which is an external device, controls the various units (the carry unit 20, the carriage unit 30, and the head unit 40) using the controller 60. The controller 60 controls the units in accordance with the print data that are received from the computer 1100 to form an image on a paper. The sensor 50 monitors the conditions within the printer 1, and outputs the results of this detection to the controller 60. The controller receives the detection results from the sensor, and controls the units based on these detection results.

The carry unit 20 is for feeding a medium (for example, paper S) into a printable position and carrying the paper in a predetermined direction (hereinafter, referred to as the carrying direction) by a predetermined carry amount during printing. The carry unit 20 has a paper supply roller 21, a carry motor 22 (hereinafter, referred to as PF motor), a carry roller 23, a platen 24, and a paper discharge roller 25. The paper supply roller 21 is a roller for automatically supplying, into the printer 1, paper that has been inserted into a paper insert opening. The paper supply roller 21 has a cross-sectional shape in the shape of the letter D, and the length of its circumference section is set longer than the carrying distance to the carry roller 23, so that the paper can be carried up to the carry roller 23 using this circumference section. The carry motor 22 is a motor for carrying paper in the carrying direction, and is constituted by a DC motor. The carry roller 23 is a roller for carrying the paper S that has been supplied by the paper supply roller 21 up to a printable region, and is driven by the carry motor 22. The platen 24 supports the paper S during printing. The paper discharge roller 25 is a roller for discharging the paper S, on which printing has finished, from the printer 1. The paper discharge roller 25 is rotated in synchronization with the carry roller 23.

The carriage unit 30 is provided with a carriage 31 and a carriage motor 32 (hereinafter, also referred to as "CR motor"). The carriage motor 32 is a motor for moving the carriage 31 back and forth in a predetermined direction (hereinafter, this is also referred to as the "carriage movement direction"), and is constituted by a DC motor. A later-described head 41 is held by the carriage 31. Thus, this head 41 can be moved back and forth in the carriage movement direction by moving the carriage 31 back and forth. Also, the carriage 31 detachably retains an ink cartridge containing ink.

The head unit 40 is for ejecting ink onto paper. The head unit 40 has the above-mentioned head 41, which includes a plurality of nozzles, and ejects ink intermittently from these nozzles. When the head 41 is moved in the carriage movement direction by moving the carriage 31, raster lines made of dots in the carriage movement direction are formed on the paper by intermittently ejecting ink while moving.

The sensor 50 includes a linear encoder 51, a rotary encoder 52, a paper detection sensor 53, and a paper width sensor 54, for example. The linear encoder 51 is for detecting the position of the carriage 31 in the carriage movement direction. The rotary encoder 52 is for detecting the amount of rotation of the carry roller 23. The paper detection sensor 53 is for detecting the position of the front end of the paper to be printed. The paper detection sensor 53 is provided in a position where it can detect the position of the front end of the paper as the paper is being fed toward the carry roller 23 by the paper supply roller 21. It should be noted that the paper detection sensor 53 is a mechanical sensor that detects the front end of the paper through a mechanical mechanism. More specifically, the paper detection sensor 53 has a lever that can be rotated in the paper carrying direction, and this lever is arranged so that it protrudes into the path over which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 31. The paper width sensor 54 is an optical sensor and detects whether or not paper is present by its light-receiving section detecting reflected light of the light that has been irradiated onto the paper from the light-emitting section. The paper width sensor 54 detects the positions of the edges of the paper while being moved by the carriage 41, so as to detect the width of the paper.

The controller 60 is a control unit for carrying out control of the printer 1. The controller 60 has an interface section 61, a CPU 62, a memory 63, and a unit control circuit 64. The interface section 61 exchanges data between the computer 1100, which is an external device, and the printer 1. The CPU 62 is an arithmetic processing device for carrying out overall control of the printer 1. The memory 63 is for ensuring a working region and a region for storing the programs for the CPU 62, for instance, and includes storage means such as a RAM, an EEPROM, or a ROM. The CPU 62 controls the various units via the unit control circuit 64 in accordance with programs stored in the memory 63.

<Regarding the Printing Operation>

Figure 11:
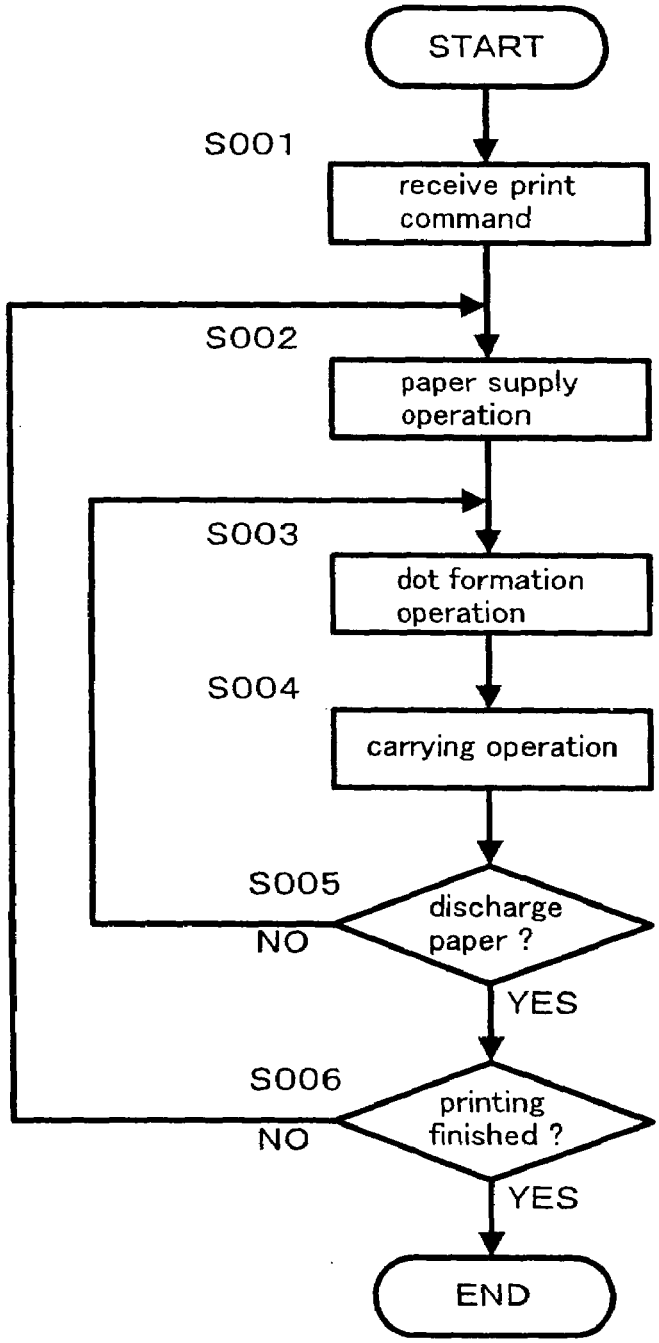
FIG. 11 is a flowchart of the processing during the printing operation.

FIG. 11 is a flowchart of the operation during printing. The various operations that are described below are achieved by the controller 60 controlling the various units in accordance with a program stored in the memory 63. This program includes codes for executing the various processes.

Receive Print Command (S001): The controller 60 receives a print command via the interface section 61 from the computer 1100. This print command is included in the header of the print data transmitted from the computer 1100. The controller 60 then analyzes the content of the various commands included in the print data that are received and uses the various units to perform the following paper supply operation, carrying operation, and dot formation operation, for example.

Paper Supply Operation (S002): Next, the controller 60 performs the paper supply operation. The paper supply operation is a process for supplying paper to be printed into the printer 1 and positioning the paper at a print start position (also referred to as the "indexed position"). The controller 60 rotates the paper supply roller 21 to feed the paper to be printed up to the carry roller 23. The controller 60 rotates the carry roller 23 to position the paper that has been fed from the paper supply roller 21 at the print start position. When the paper has been positioned at the print start position, at least some of the nozzles of the head 41 are in opposition to the paper.

Dot Formation Operation (S003): Next, the controller 60 performs the dot formation operation. The dot formation operation is an operation of intermittently ejecting ink from the head 41 moving in the carriage movement direction, so as to form dots on the paper. The controller 60 drives the carriage motor 32 to move the carriage 31 in the carriage movement direction. Then, the controller 60 causes ink to be ejected from the head 41 in accordance with the print data while the carriage 31 is moving. Dots are formed on the paper when ink ejected from the head 41 lands on the paper.

Carrying Operation (S004): Next, the controller 60 performs the carrying operation. The carrying operation is a process for moving the paper relative to the head 41 in the carrying direction. The controller 60 drives the carry motor to rotate the carry roller and there by carry the paper in the carrying direction. Through this carrying operation, the head 41 becomes able to form dots at positions that are different from the positions of the dots formed in the preceding dot formation operation.

Paper Discharge Judgment (S005): Next, the controller 60 determines whether or not to discharge the paper that is being printed. The paper is not discharged if there is still data for printing on the paper that is currently being printed. In this case, the controller 60 repeats in alternation the dot formation operation and the carrying operation until there are no longer any data for printing, gradually printing an image made of dots on the paper. When there are no longer data for printing on the paper that is currently being printed, the controller 60 discharges that paper. The controller 60 discharges the printed paper to the outside by rotating the paper discharge roller. It should be noted that whether or not to discharge the paper can also be determined based on a paper discharge command included in the print data.

Judgment Whether Printing is Finished (S006): Next, the controller 60 determines whether or not to continue printing. If the next sheet of paper is to be printed, then printing is continued and the paper supply operation for the next sheet of paper is started. If the next sheet of paper is not to be printed, then the printing operation is finished.

<Regarding the Configuration of the Head>

Figure 12:
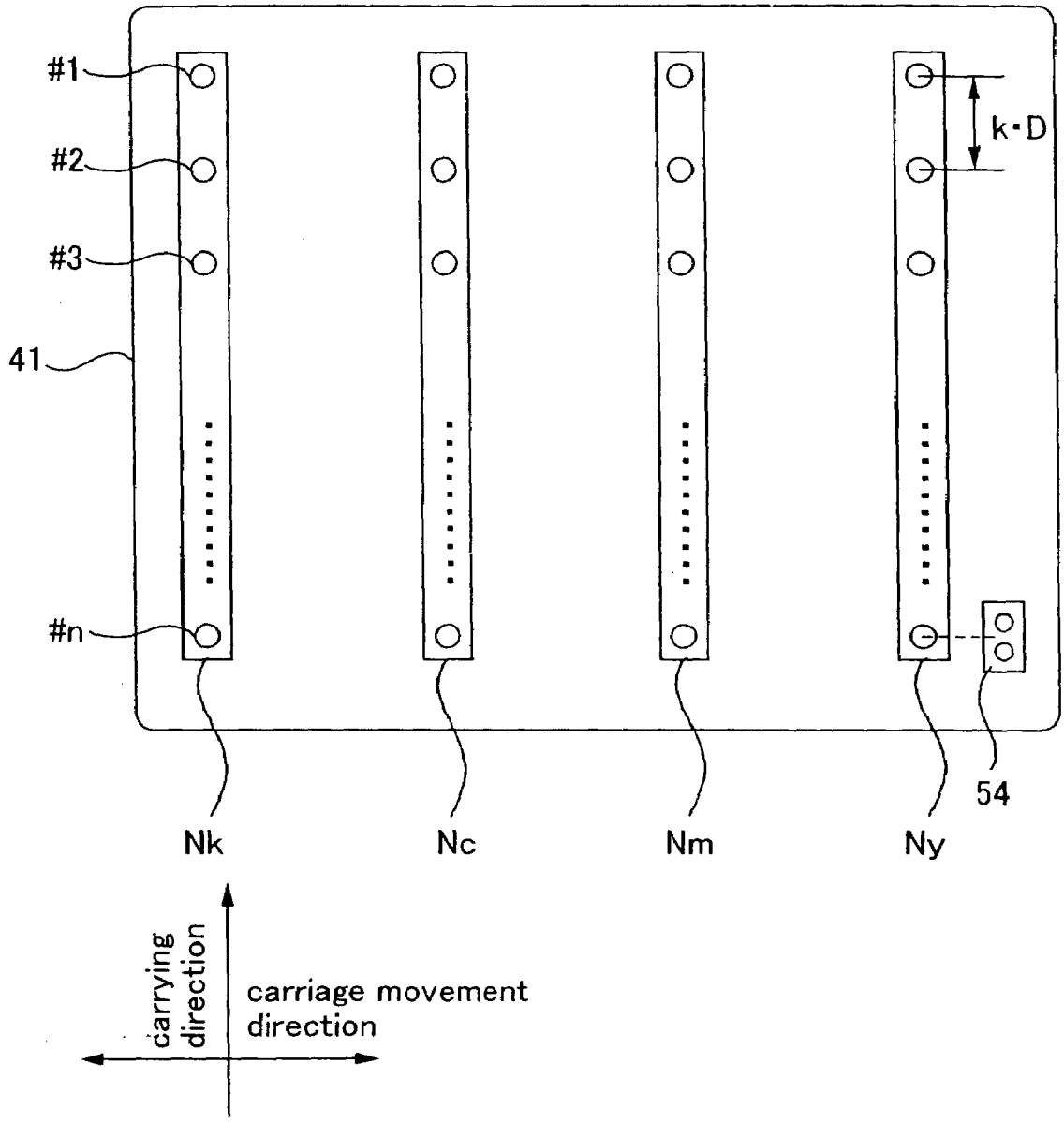
FIG. 12 is an explanatory diagram showing the arrangement of the nozzles.

FIG. 12 is an explanatory diagram showing the arrangement of the nozzles in the lower surface of the head 41. A black ink nozzle row Nk, a cyan ink nozzle row Nc, a magenta ink nozzle row Nm, and a yellow ink nozzle row Ny are formed in the lower surface of the head 41. Each nozzle row is provided with n (for example, n=180) nozzles, which are ejection openings for ejecting the inks of the respective colors.

The plurality of nozzles of the nozzle rows are arranged in a row at a constant spacing (nozzle pitch: k·D) in the carrying direction. Here, D is the minimum dot pitch in the carrying direction (that is, the spacing of the dots formed on the paper S at the highest resolution). Also, k is an integer of 1 or more. For example, if the nozzle pitch is 180 dpi (1/180 inch), and the dot pitch in the carrying direction is 720 dpi (1/720), then k=4.

The nozzles of the nozzle rows are each assigned a number (#1 to #n) that becomes smaller the more downstream the nozzle is located. That is, the nozzle #1 is positioned more downstream in the carrying direction than the nozzle #n. Each nozzle is provided with a piezo element (not shown) as a drive element for driving the nozzle and letting it eject ink droplets.

<Regarding the Driving of the Head>

Figure 13:
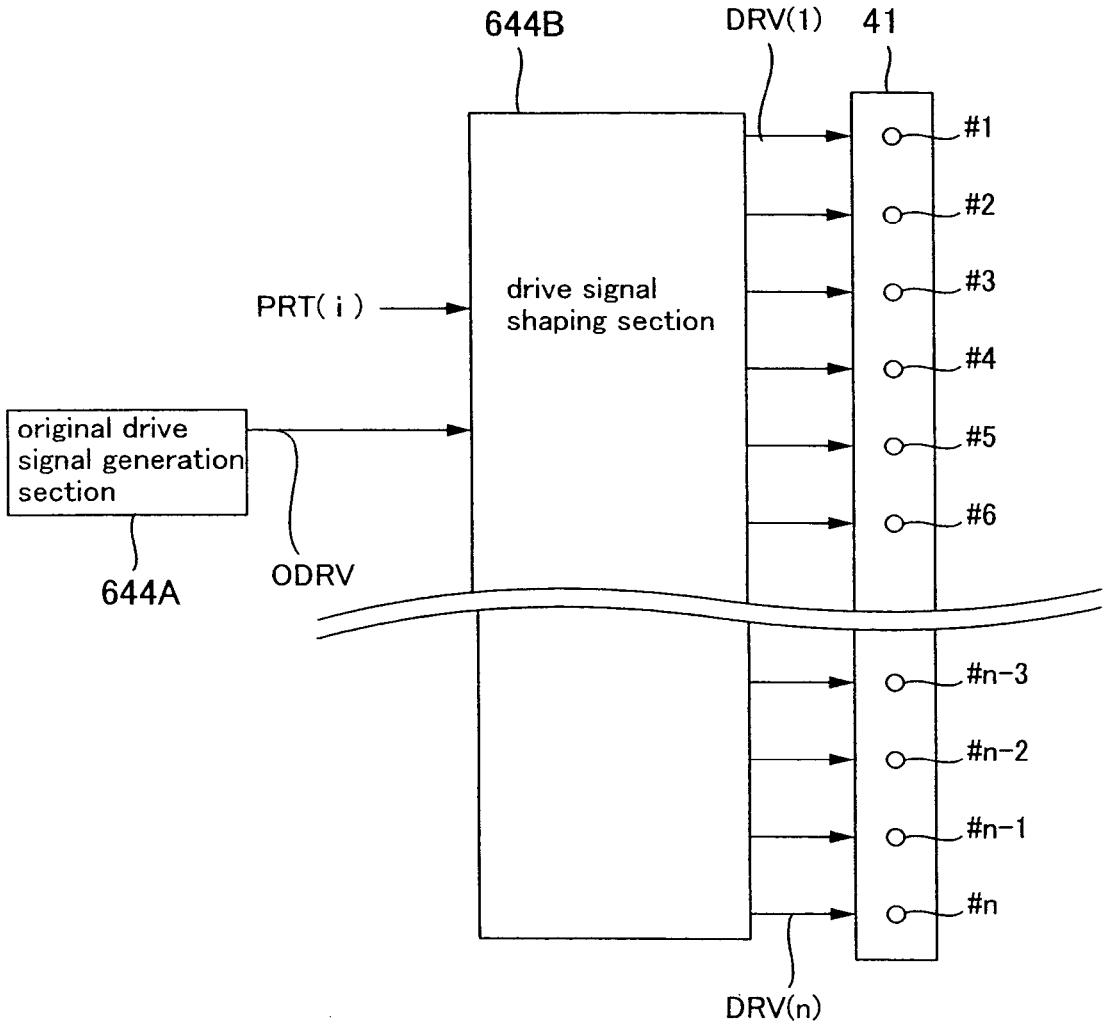
FIG. 13 is an explanatory diagram of the drive circuit of the head unit.

FIG. 13 is an explanatory diagram of the drive circuit of the head unit 40. This drive circuit is provided in the unit control circuit 64 mentioned earlier, and as shown in the drawing, it is provided with an original drive signal generation section 644A and a drive signal shaping section 644B. In this embodiment, a drive circuit for these nozzles #1 to #n is provided for each nozzle row, that is, for each nozzle row of the colors black (K), cyan (C), magenta (M), and yellow (Y), such that the piezo elements are driven individually for each nozzle row. The number in parentheses at the end of the name of each of the signals in the diagram indicates the number of the nozzle to which that signal is supplied.

When a voltage of a predetermined duration is applied between electrodes provided at both ends of a piezo element, the piezo element expands for the duration of voltage application and deforms a lateral wall of the ink channel. As a result, the volume of the ink channel shrinks in accordance with the expansion of the piezo element, and an amount of ink that corresponds to this shrinkage is ejected from each nozzle #1 to #n of the respective colors as ink droplets.

The original drive signal generation section 644A generates an original signal ODRV that is shared by the nozzles #1 to #n. The original signal ODRV is a signal that includes a plurality of pulses during the time in which the carriage 31 moves across the length of a single pixel.

The drive signal shaping section 644B receives a print signal PRT(i) together with an original signal ODRV that is output from the original signal generation section 644A. The drive signal shaping section 644B shapes the original signal ODRV in correspondence with the level of the print signal PRT(i) and outputs it toward the piezo elements of the nozzles #1 to #n as a drive signal DRV(i). The piezo elements of the nozzles #1 to #n are driven in accordance with the drive signal DRV from the drive signal shaping section 644B.

<Regarding Drive Signals of the Head>

Figure 14:
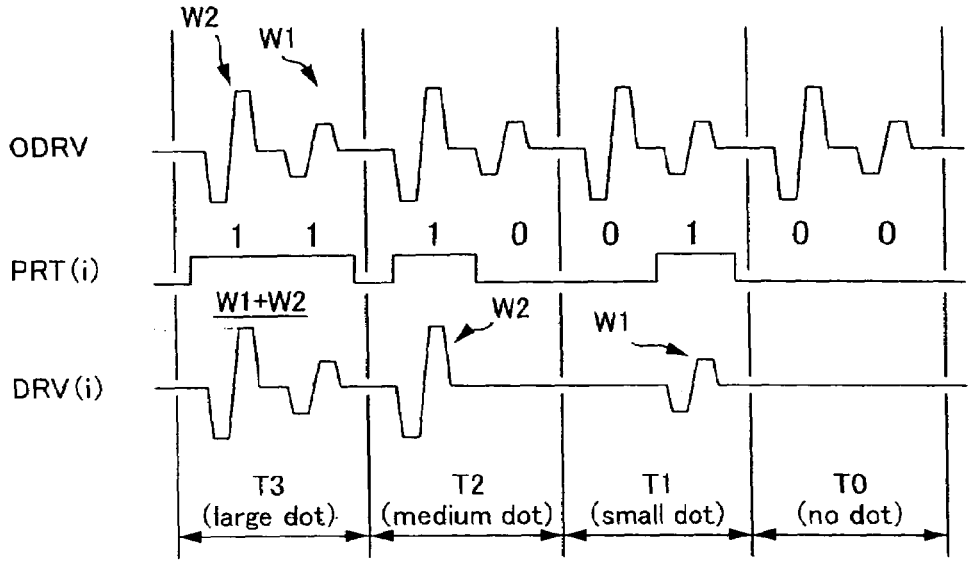
FIG. 14 is a timing charge for explaining the various signals.

FIG. 14 is a timing charge for explaining the various signals. That is, this figure shows a timing chart for the various signals, namely the original signal ODRV, the print signal PRT(i), and the drive signal DRV(i).

The original signal ODRV is a signal that is supplied from the original signal generation section 644A and shared by the nozzles #1 to #n. In this embodiment, the original signal ODRV includes two pulses, namely a first pulse W1 and a second pulse W2, within the period during which the carriage 31 moves across the length of a single pixel. It should be noted that the original signal ODRV is output from the original signal generation section 644A to the drive signal shaping section 644B.

The print signal PRT is a signal corresponding to the pixel data for a single pixel. That is, the print signal PRT is a signal corresponding to the pixel data included in the print data. In this embodiment, the print signals PRT(i) are signals having two bits of information per pixel. The drive signal shaping section 644B shapes the original signal ODRV in correspondence with the signal level of the print signal PRT and outputs the drive signal DRV.

The drive signal DRV is a signal that is obtained by blocking the original signal ODRV in correspondence with the level of the print signal PRT. That is, when the level of the print signal PRT is "1" then the drive signal shaping section 644B allows the corresponding pulse of the original signal ODRV to pass unchanged and sets it as the drive signal DRV. On the other hand, when the level of the print signal PRT is "0", the drive signal shaping section 644B blocks the pulse of the original signal ODRV. It should be noted that the drive signal shaping section 644B outputs the drive signal DRV to the piezo elements that are provided nozzle by nozzle. The piezo elements are then driven in accordance with the drive signal DRV.

When the print signal PRT(i) corresponds to the two bits of data "01" then only the first pulse W1 is output in the first half of the pixel period. Accordingly, a small ink droplet is ejected from the nozzle, forming a small-sized dot (small dot) on the paper. When the print signal PRT(i) corresponds to the two bits of data "10" then only the second pulse W2 is output in the second half of a single pixel interval. Accordingly, a medium-sized ink droplet is ejected from the nozzle, forming a medium-sized dot (medium dot) on the paper. When the print signal PRT(i) corresponds to the two bits of data "11" then both the first pulse W1 and the second pulse W2 are output during a single pixel interval. Accordingly, a small ink droplet and a medium ink droplet are ejected from the nozzle, forming a large-sized dot (large dot) on the paper. When the print signal PRT(i) corresponds to the two bits of data "00" then neither the first pulse W1 or the second pulse W2 are output during the pixel period. In this case, no ink droplet of any size is ejected from the nozzle, and no dot is formed on the paper.

As described above, the drive signal DRV(i) in a single pixel period is shaped so that it may have four different waveforms corresponding to the four different values of the print signal PRT(i).

Regarding the print modes

The print modes that can be executed by the printer 1 according to the present embodiment are described below. As the print modes, an interlaced mode, a two-pass overlap mode, and a four-pass overlap mode, for example, can be executed. The print mode to be selected is determined by the printer driver based on the conditions that the user has set with the user interface.

<Regarding the Interlaced Mode>

Figure 15A:
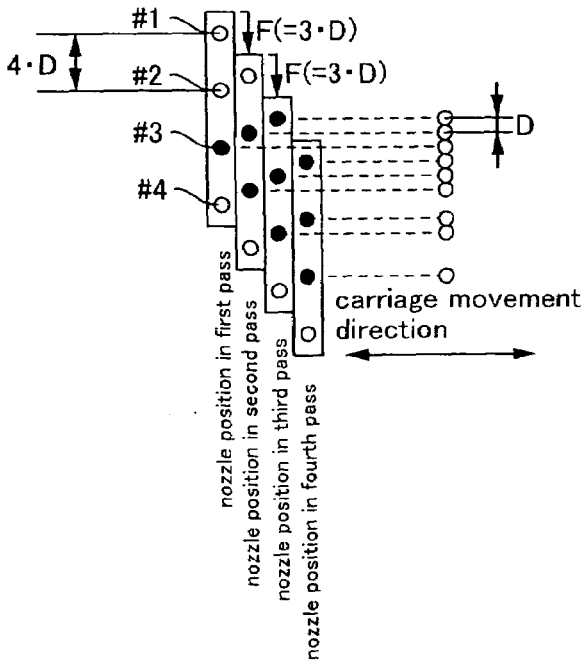
FIGS. 15A and 15B are explanatory diagrams of the interlaced mode.
Figure 15B:
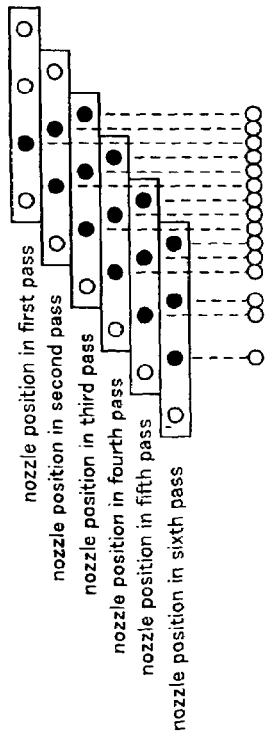

FIGS. 15A and 15B are explanatory diagrams of the interlaced mode. It should be noted that for the sake of simplifying the description, the nozzle rows shown in place of the head 41 are illustrated to be moving with respect to the paper S, but the diagrams show the relative positional relationship between the nozzle rows and the paper S, and in fact it is the paper S that moves in the carrying direction. In the diagrams, the nozzles represented by a black circles are the nozzles that actually eject ink, and the nozzles represented by white circles are nozzles that do not eject ink. FIG. 15A shows the nozzle positions in the first through fourth passes and how the dots are formed by those nozzles. FIG. 15B shows the nozzle positions in the first through sixth passes and how the dots are formed.

Here, the "interlaced mode" refers to a print mode in which k is at least 2 and a raster line that is not recorded is sandwiched between the raster lines that are recorded in a single pass. Also, "pass" refers to a single movement of the nozzle rows in the carriage movement direction. "Raster line" is a row of dots lined up in the carriage movement direction.

With the interlaced mode illustrated in FIG. 15A and FIG. 15B, each time the paper S is carried in the carrying direction by a constant carry amount F, the nozzles record a raster line immediately above the raster line that was recorded in the pass immediately before. In order to record the raster lines in this way using a constant carry amount, the number N (which is an integer) of nozzles that actually eject ink is coprime to k, and the carry amount F is set to N·D.

In the figures, the nozzle row has four nozzles arranged in the carrying direction. However, since the nozzle pitch k of the nozzle row is 4, not all the nozzles can be used in order to satisfy the condition for the interlaced mode, that is, "N and k are coprime". Accordingly, three of the four nozzles are used in this interlaced mode. Furthermore, because three nozzles are used, the paper S is carried by a carry amount 3·D. As a result, for example a nozzle row with a nozzle pitch of 180 dpi (4·D) is used to form dots on the paper S at a dot pitch of 720 dpi (=D).

The figures show the manner in which continuous raster lines are formed, with the first raster line being formed by the nozzle #1 in the third pass, the second raster line being formed by the nozzle #2 in the second pass, the third raster line being formed by the nozzle #3 in the first pass, and the fourth raster line being formed by the nozzle #1 in the fourth pass. It should be noted that ink is ejected only from nozzle #3 in the first pass, and ink is ejected only from nozzle #2 and nozzle #3 in the second pass. The reason for this is that if ink is ejected from all of the nozzles in the first and second passes, it is not possible to form continuous raster lines on the paper S. It should be noted that from the third pass on, three nozzles (#1 to #3) eject ink and the paper S is carried by a constant carry amount F (=3·D), forming continuous raster lines at the dot pitch D.

In order to simplify description, there were only four nozzles in the description above. However, in practice there are 180 nozzles. In this case, since the nozzle pitch k is 4, in order to fulfill the condition for the interlaced mode, which is that "N and k are coprime," not all the nozzles can be used. Therefore, 179 of the 180 nozzles are used for the interlaced mode. Furthermore, because 179 nozzles are used, the paper is carried using a carry amount of 179·D.

<Regarding the Two-Pass Overlap Mode>

Figure 16:
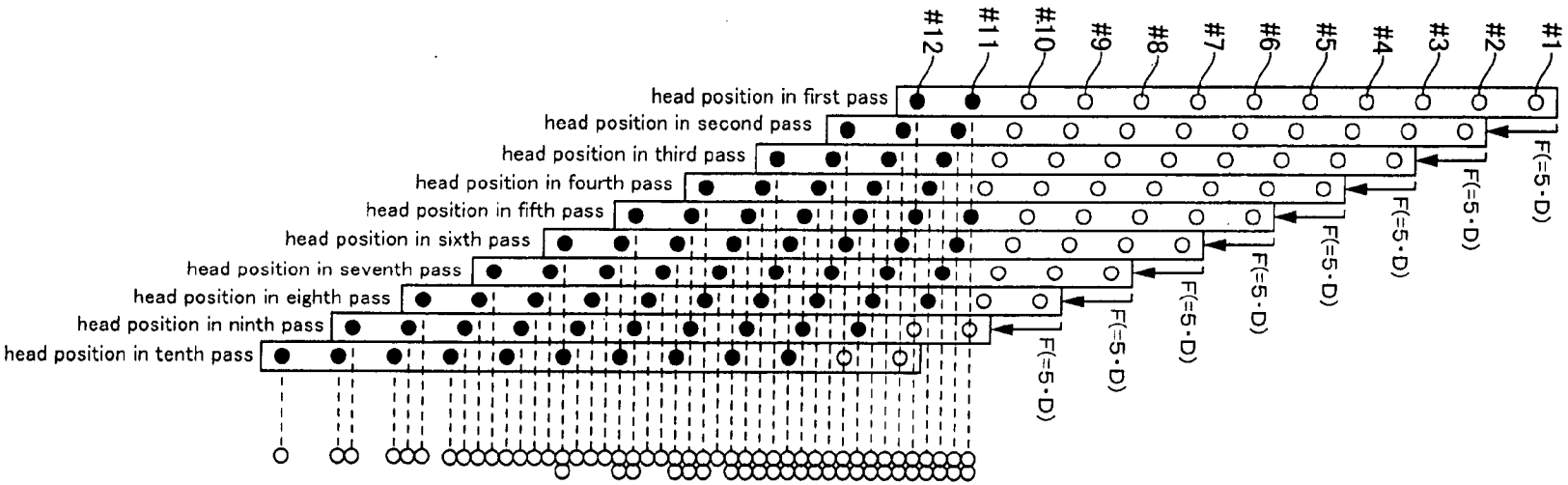
FIG. 16 is an explanatory diagram of a two-pass overlap mode when using 12 nozzles.

FIG. 16 is an explanatory diagram of the two-pass overlap mode for the case of 12 nozzles. In the above-described interlaced mode, a single raster line is formed by a single nozzle. With the overlap mode, on the other hand, a single raster line is formed with two or more nozzles. More specifically, in the two-pass overlap mode, a single raster line is formed with two nozzles. It should be noted that the reason for calling this the two-pass overlap mode is that two dot formation operations (also referred to as "passes") are required for finishing one raster line.

In overlap printing, each time the paper is carried by the constant carry amount F in the carrying direction, the nozzles form dots intermittently at every several dots. Then, by letting another nozzle form dots in another pass to complement the intermittent dots that have already been formed, a single raster line is completed by a plurality of nozzles. The overlap number M is defined as the number M of passes needed to complete a single raster line. In the figure, since each nozzle forms dots intermittently at every other dot, dots are formed in every pass either at the odd numbered pixels or at the even numbered pixels. Since a single raster line is formed using two nozzles, the overlap number is M=2. It should be noted that the overlap number is M=1 in the case of the above-described interlaced mode.

In overlap printing, the following conditions are necessary in order to carry out recording with a constant carry amount: (1) N/M is an integer, (2) N/M and k are coprime, and (3) the carry amount F is set to (N/M)·D.

In the figure, the nozzle row has twelve nozzles arranged in the carrying direction. However, since the nozzle pitch k of the nozzle row is 4, in order to fulfill the condition for performing overlap printing, which is that "N/M and k are coprime," not all the nozzles can be used. Accordingly, only 10 of the 12 nozzles are used for the two-pass overlap mode. Furthermore, because 10 nozzles are used, the paper is carried using a carry amount of 5·D. As a result, using a nozzle row with a nozzle pitch of 180 dpi (4·D) for example, dots are formed on the paper with a dot spacing of 720 dpi (=D). Furthermore, in a single pass, the nozzles form dots intermittently in the movement direction (carriage movement direction) at every other dot.

In the figure, raster lines in which two dots are written in the movement direction have already been completed. For example, in the figure, the first through the eighteenth raster lines have already been completed. Raster lines in which only one dot is written are raster lines in which dots have been formed intermittently at every other dot. For example, in the nineteenth and the twenty-third raster lines, dots have been formed intermittently at every other dot. It should be noted that the ninth raster line, in which dots have been intermittently formed at every other dot, is completed by letting the nozzle #3 fill it up in the eleventh pass.

In the pass 10 and thereafter, the 10 nozzles (#3 to #12) eject ink, and the paper is carried by a constant carry amount F (=5·D), and thus continuous raster lines are formed with a dot spacing of D.

In the two-pass overlap mode, the first raster line is formed with the nozzle #11 and the nozzle #6. The second raster line is formed with the nozzle #10 and the nozzle #5. Thus, it is known in beforehand, which raster line is formed by which nozzles.

In order to simplify the description, there were twelve nozzles in the description above. However, in practice there are 180 nozzles. In this case, since the nozzle pitch k is 4, in order to fulfill the condition for the overlap mode, which is that "N/M and k are coprime," not all the nozzles can be used. Therefore, 178 of the 180 nozzles are used to perform overlap printing. Furthermore, because 178 nozzles are used, the paper is carried using a carry amount of 89·D.

<Regarding the Four-Pass Overlap Mode>

Figure 17:
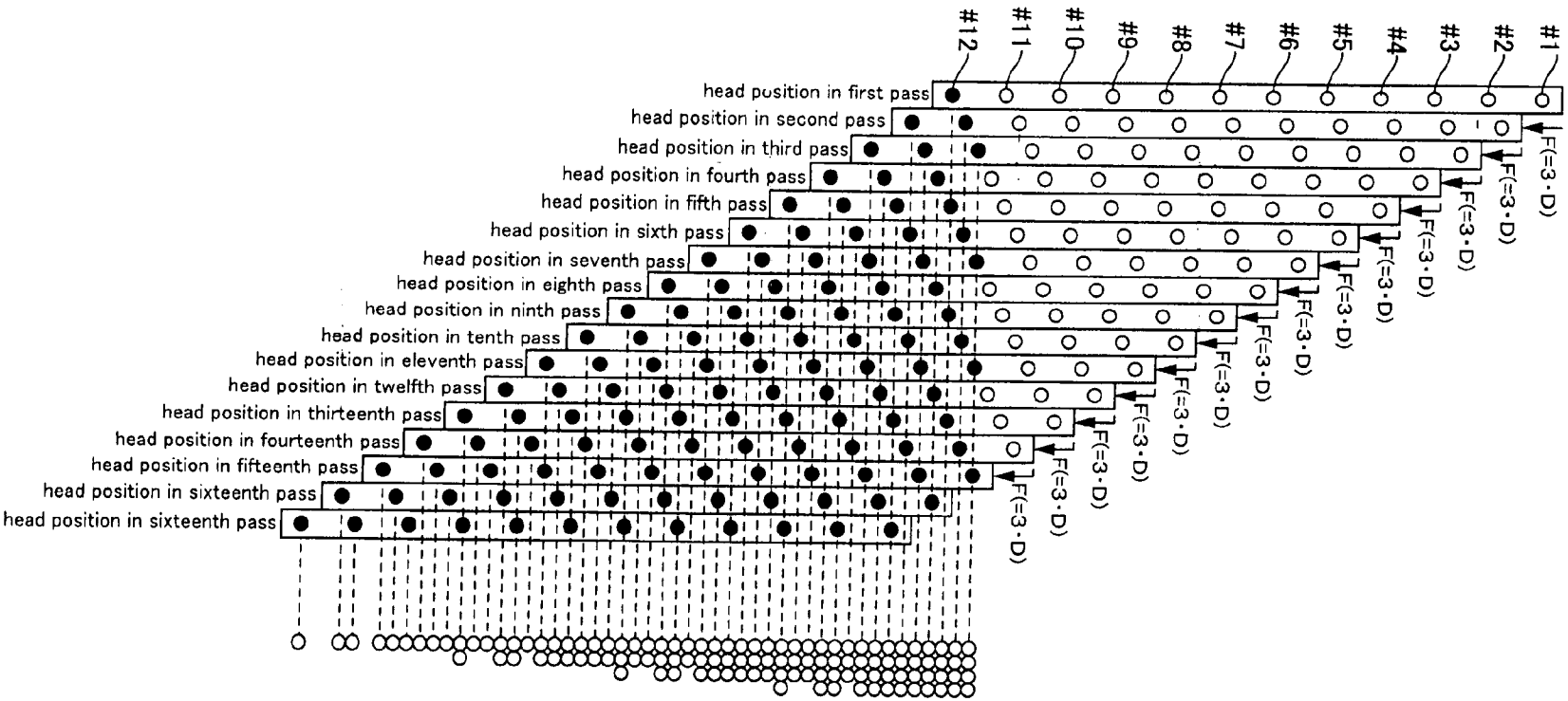
FIG. 17 is an explanatory diagram of a four-pass overlap mode when using 12 nozzles.

FIG. 17 is an explanatory diagram of the four-pass overlap mode when using 12 nozzles. In the above-described two-pass overlap mode, a single raster line is formed with two nozzles. On the other hand, in the four-pass overlap mode, a single raster line is formed with four nozzles.

In the figure, the nozzle row has twelve nozzles arranged in the carrying direction. In the four-pass overlap mode, since the overlap number is 4, the condition that "N/M and k are coprime" is satisfied even when using all nozzles. Accordingly, all (twelve) nozzles are used for the four-pass overlap mode. Furthermore, because twelve nozzles are used, the paper is carried using a carry amount of 3·D. As a result, using a nozzle row with a nozzle pitch of 180 dpi (4·D) for example, dots are formed on the paper with a dot spacing of 720 dpi (=D). Furthermore, in a single pass, the nozzles form dots intermittently in the movement direction at every four dots. In the figure, raster lines in which four dots are written in the movement direction have already been completed. For example, in the figure, the first through the ninth raster lines have already been completed. Raster lines indicated by three dots are raster lines in which dots have been formed in three out of four pixels. For example, in the tenth raster line, dots have been formed in three out of four pixels.

In the pass 16 and thereafter, the 12 nozzles (#1 to #12) eject ink, and the paper is carried by a constant carry amount F (=3·D), and thus continuous raster lines are formed with a dot spacing of D.

In the four-pass overlap mode, the first raster line is formed with the nozzle #10, the nozzle #7, the nozzle #4 and the nozzle #1. The second raster line is formed with the nozzle #11, the nozzle #8, the nozzle #5 and the nozzle #2. Thus, also in the four-pass overlap mode, it is known in beforehand, which raster line is formed by which nozzles.

In order to simplify the description, there were twelve nozzles in the description above. However, in practice there are 180 nozzles. In this case, the condition for the interlaced mode, which is that "N/M and k are coprime," is satisfied even when using all nozzles. Furthermore, because 180 nozzles are used, the paper is carried using a carry amount of 45·D.

<Regarding the Influence of the Nozzle Characteristics>

The 180 nozzles have, for example, a certain variance in their aperture diameter due to manufacturing reasons, so that also their ink ejection amount differs. And due to the discrepancies among the ejection characteristics of individual nozzles, there are darkness irregularities in the image printed on the paper, and the image quality of printed images may decrease.

Figure 18:
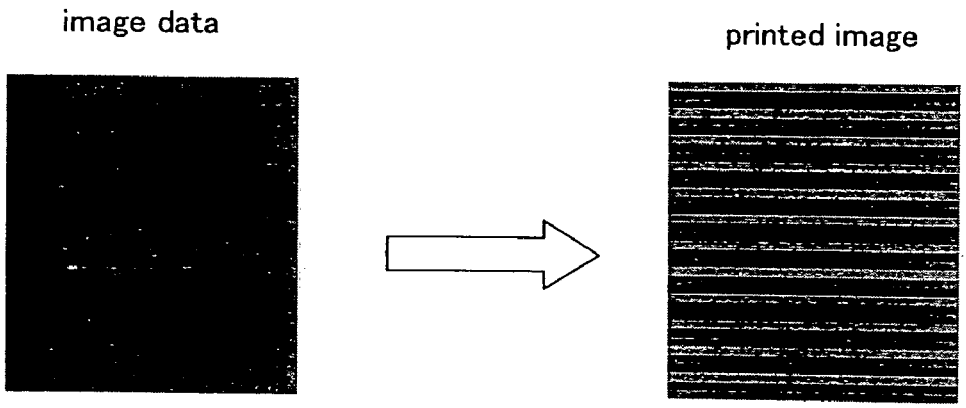
FIG. 18 is an explanatory diagram of the relation between the image data and the printed image.

FIG. 18 is an explanatory diagram of the relation between the image data and the printed image that is actually printed on paper. Here, in order to simplify explanations, the image data is made of pixel data all having the same gradation, and the image expressed by the image data has a uniform darkness. If all the nozzles would eject ink in an ideal manner based on this image data, then the image that is printed on paper would have a uniform darkness, like the image expressed by the image data.

However, since the ejection characteristics of the individual nozzles differ in practice, not all the nozzles eject ink in an ideal manner. Accordingly, when the individual ink ejection characteristics differ, the image that is actually printed on paper becomes an image having stripes along the movement direction. The reason for this is that the plurality of dot lines constituting the printed image are each formed by different nozzles.

Also, even when one raster line is formed by a plurality of nozzles as in the overlap mode, the printed image will have stripes along the movement direction. This is because ink is ejected from nozzles moving in the movement direction, so that the ink landing on the paper tends to spread in the movement direction and the darkness of the pixels lining up in the movement direction is averaged, thereby making this average darkness differ for each raster line.

In the embodiment explained in the following, it is ensured that there are no stripes in the image that is actually printed on paper, thus improving the image quality of the printed image.

Outline of the Present Embodiment

Figure 19:
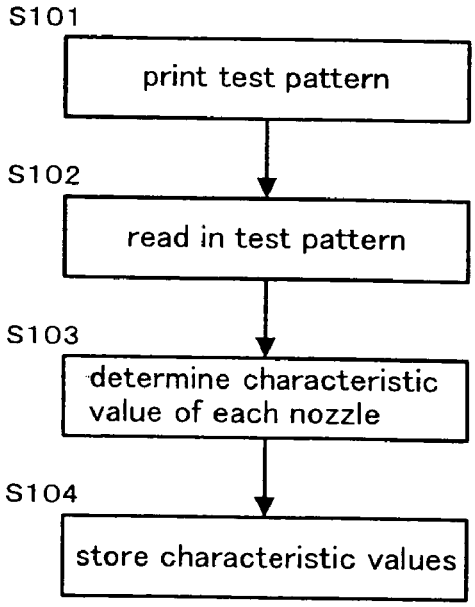
FIG. 19 is a flowchart up to the point when characteristic values of each of the nozzles are stored.

FIG. 19 is a flowchart up to the point when a characteristic value of each nozzle is stored. This process is performed during the manufacture of the printer in the factory, before the printer is shipped from the factory.

First, the printer, which has been assembled in the factory, prints a test pattern on paper (S101). Next, this test pattern is read in by a scanner that is a device separate from the printer (S103). Next, a computer or a inspector in the factory determines a characteristic value for each nozzle from the reading result of the scanner (S103). The determined characteristic values are then stored in a memory in the printer (S104). This process is described in detail later.

Figure 20:
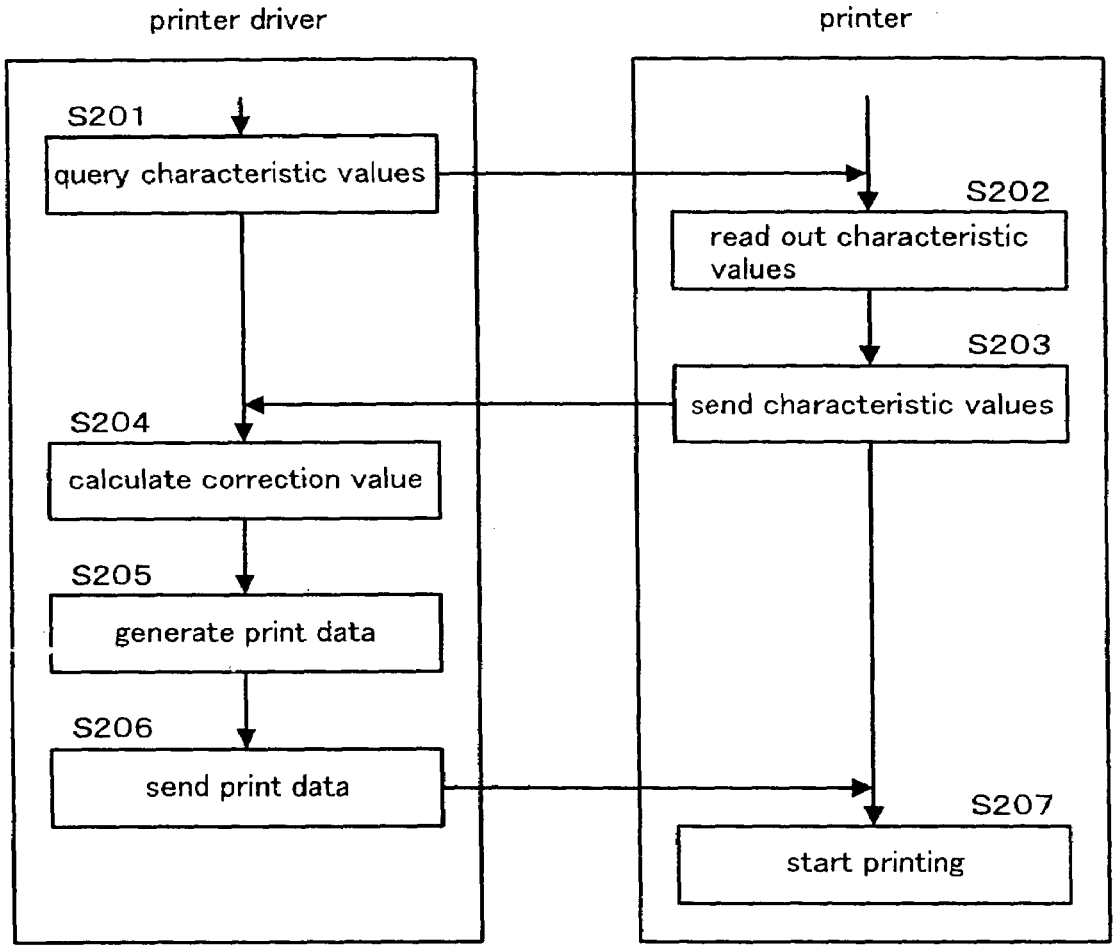
FIG. 20 is a flowchart of the operation during printing.

FIG. 20 is a flowchart of the operation during printing. These processes are performed at the place of the user who has bought the printer. The user who has bought the printer installs the printer driver on his/her computer in beforehand and connects the computer to the printer. The printer driver is stored on a CD-ROM that is bundled with the purchased printer, or it may be downloaded over the Internet to the computer from the website of the printer manufacturer.

First, the printer driver sends a query about the characteristic values of the nozzles to the printer (S201). Having received this query, the printer reads out the characteristic values from the memory within the printer. Next, the printer sends the characteristic values that have been read out to the printer driver (S203). The printer driver calculates correction values from the received characteristic values (S204). The method for calculating these correction values is described in detail later. Next, the printer driver converts the image data into print data, in accordance with the correction values (S205). Then, the printer driver sends the print data to the printer (S206), and the printer starts to print in accordance with the print data (S207).

Method for Determining a Characteristic Value for Each Nozzle

First, the processes in FIG. 19 are explained in detail in the following.

<S101: Printing the Test Pattern>

Figure 21A:
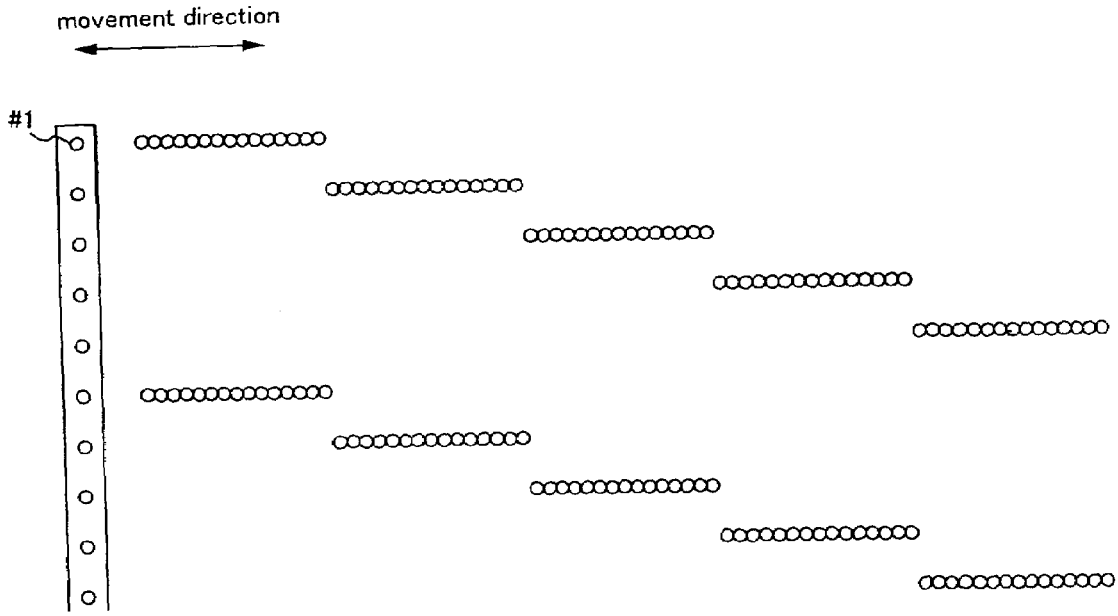
FIG. 21A is a diagram illustrating the state at the start of printing the test pattern.
Figure 21B:
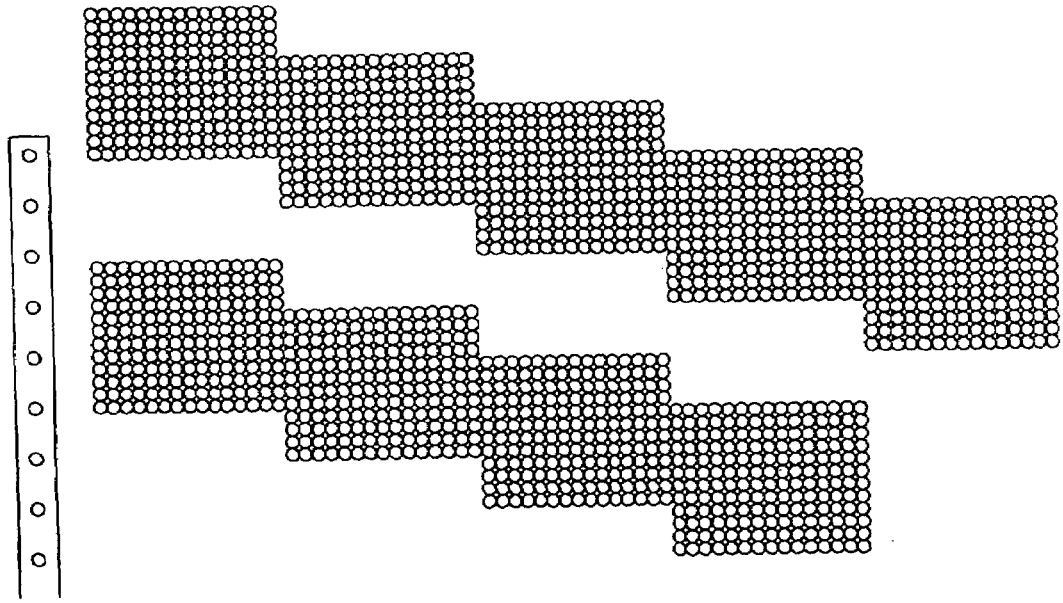
FIG. 21B is a diagram illustrating the state midway during printing the test pattern.

FIG. 21A and FIG. 21B are explanatory diagrams illustrating a method for printing the test pattern. FIG. 21A is an explanatory diagram illustrating the state at the start of printing the test pattern. FIG. 21B is an explanatory diagram illustrating the state midway during printing the test pattern. A black ink nozzle row is shown on the left side in the figures. The other nozzle rows also print a test pattern just like the black ink nozzle row, so that their further explanation has been omitted.

After the paper has been carried to the printing region, the controller moves the carriage in the movement direction, makes the nozzles eject ink, and starts the printing of the test pattern.

After the carriage starts to move, the controller first makes the nozzle #1, the nozzle #6, . . . , the nozzle #n+1 eject ink intermittently. When the carriage has moved a predetermined distance, the controller stops ejection of ink from these nozzles, and subsequently makes the nozzle #2, the nozzle #7, . . . , the nozzle #n+2 eject ink intermittently. When the carriage has again moved a predetermined distance, the controller stops ejection of ink from these nozzles, and subsequently makes the nozzle #3, the nozzle #8, . . . , the nozzle #n+3 eject ink intermittently. This operation is performed repeatedly, and after the ejection of ink from the nozzle #5, the nozzle #10, . . . , the nozzle #n+5 is finished, the controller stops the carriage.

After the carriage is stopped, the controller carries the paper by the distance of one dot, using the carry unit. Thus, the nozzles and the paper are moved relatively to one another, and the nozzles can form dots at a different location on the paper.

After the paper has been carried by the distance corresponding to one dot, the controller again makes the carriage move in the movement direction, makes the nozzles eject ink in the same order as before, and then stops the carriage.

When this ink ejection operation and paper carry operation are repeated, block-shaped patterns (block patterns) corresponding to the number of nozzles are formed by the dots which are formed with the same nozzles, as shown in FIG. 21B.

Figure 22:
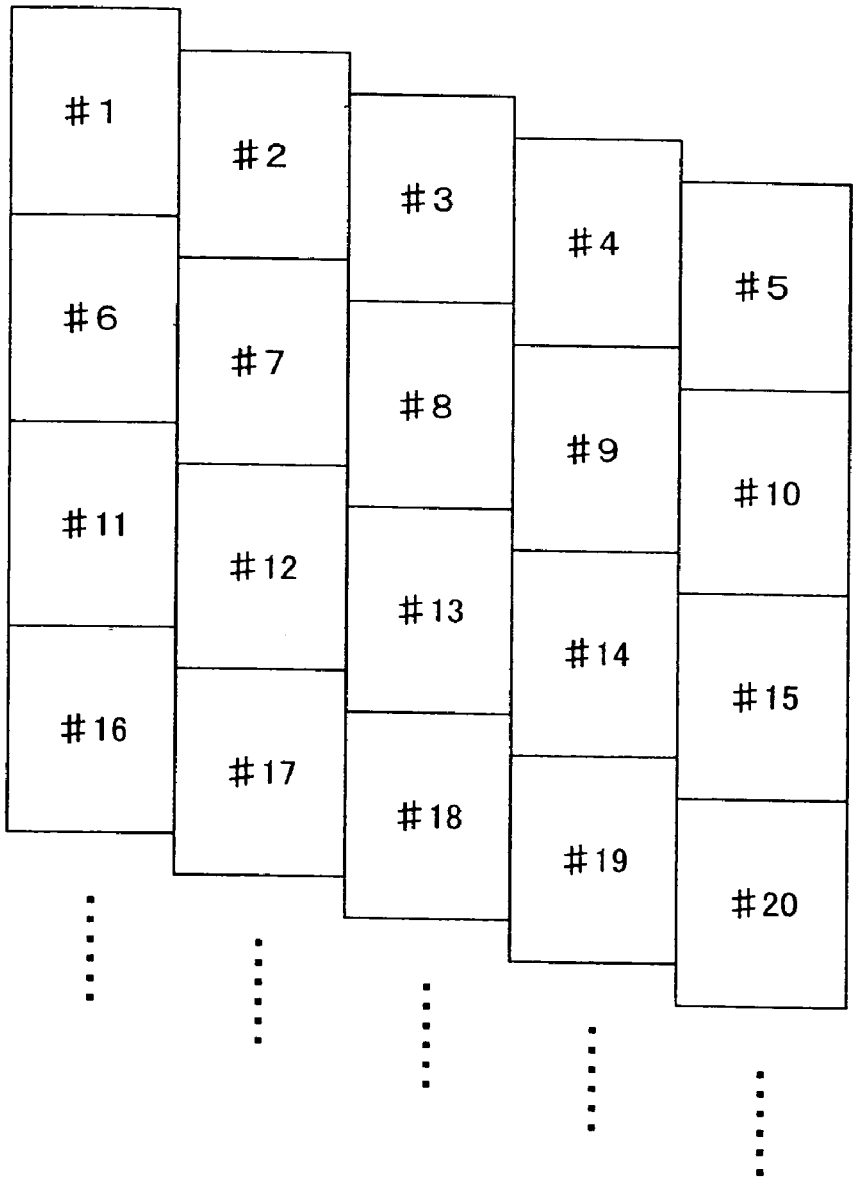
FIG. 22 is an explanatory diagram of the configuration of the test pattern.

FIG. 22 is an explanatory diagram of the configuration of the test pattern formed with the above-described process. The test pattern is formed by a number of block patterns corresponding to the number of nozzles. Each block pattern is made of dots that are formed by a specific nozzle. It should be noted that for illustrative reasons, the corresponding nozzle numbers are written in the block patterns in the figure, but in the actual block patterns, there are no such numbers, and they are patterns in which predetermined regions are completely filled with ink.

In the present embodiment, five block patterns are lined up in the movement direction and 36 block patterns are lined up in the carrying direction. In the present embodiment, only the test pattern formed by the black ink nozzle row is shown, but the test patterns formed by the other nozzle rows are lined up in the movement direction with the test pattern formed by the black ink nozzle row.

<S102: Regarding the Reading of the Test Pattern>

After the test pattern has been printed, an inspector in the factory reads in this test pattern using a scanner. Here, the position of the block patterns on the paper is determined in advance, so that it is possible to detect the darkness of each of the block patterns by analyzing the reading result of the test pattern (the image data of the test pattern).

<S103: Regarding the Determination of the Characteristic Value for Each Nozzle>

The darkness of the block patterns differs from nozzle to nozzle. For example, a nozzle having the characteristic of ejecting comparatively much ink forms comparatively large dots on the paper, so that it forms a block pattern of high darkness. By contrast, a nozzle having the characteristic of ejecting comparatively little ink forms comparatively small dots on the paper, so that it forms a block pattern of low darkness. Therefore, the darkness of each block pattern reflects the ejection characteristics of the nozzle that formed that block pattern.

Accordingly, a computer or an inspector in the factory sets a characteristic value representing the ejection characteristic of each nozzle in accordance with the darkness of each block pattern that has been detected from the test pattern.

Here, the darkness of a block pattern formed by an ideal reference nozzle that has been made as designed is taken as a reference darkness. This reference nozzle does not have to be a nozzle of the printer under test.

If the darkness of the block pattern formed by a given nozzle is 2% darker than the reference darkness, then the characteristic value for this nozzle is set to −2%. If the darkness of the block pattern formed by a given nozzle is 2% smaller than the reference darkness, then the characteristic value for this nozzle is set to +2%. Thus, based on the darkness of each block pattern, the computer or inspector in the factory creates a table correlating each of the nozzles and their characteristic values.

It should be noted that the created table is stored in the printer's memory in S104.

FIG. 23 is an explanatory diagram of the table stored in the printer's memory. Here, for the sake of explanation, the number of nozzles is twelve. In practice, the table correlates 180 nozzles with their respective characteristic values. It should be noted that the ink ejection amount from the nozzles positioned at the ends of the nozzle row (nozzle #1 and nozzle #12) becomes smaller due to the fact that the ink flow path of the head becomes longer, so that their characteristic values become positive.

The Processing During Printing in the Present Embodiment

The following is an explanation of a method for calculating the correction values and a method for creating the print data, as shown in FIG. 20. It should be noted that explanations of the other processes in this figure have been omitted.

<S204: Regarding the Calculation of the Correction Values>

As noted in the above explanations of the print modes, it is known in advance which raster lines are formed by which nozzles.

Figure 24:
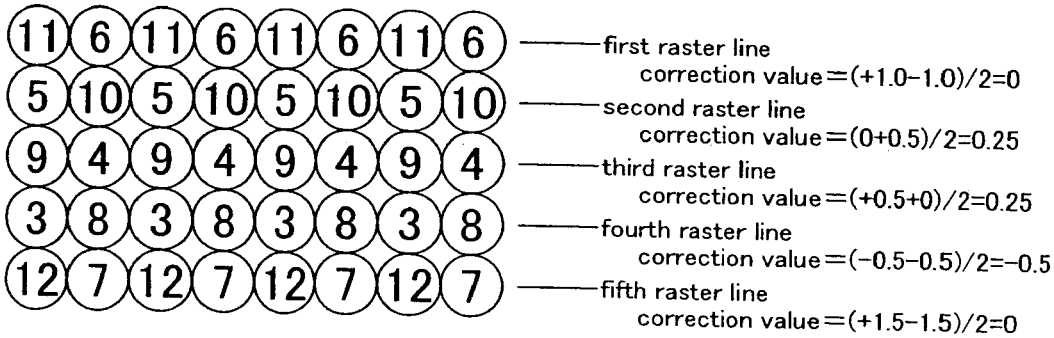
FIG. 24 is an explanatory diagram showing how dots are formed in the case of the two-pass overlap mode with twelve nozzles.

FIG. 24 is an explanatory diagram showing how dots are formed in the case of the two-pass overlap mode with twelve nozzles. In the figure, the circles represent the dots that are formed on the paper. Also, in the figure, the numbers within these circles represent the number of the nozzle that has ejected the ink droplet forming that dot.

In the two-pass overlap mode, the first raster line is formed by the nozzle #11 and the nozzle #6. The second raster line is formed by the nozzle #10 and the nozzle #5. The third raster line is formed by the nozzle #9 and the nozzle #4. The fourth raster line is formed by the nozzle #8 and the nozzle #3. The fifth raster line is formed by the nozzle #12 and the nozzle #7. The sixth raster line is not shown in the figure, but it is formed by the same nozzles as the first raster line. The reason for this is that in the two-pass overlap mode with twelve nozzles, the carry amount is 5·D, so that raster lines formed by the same nozzles appear per every five raster lines. Consequently, for example the seventh raster line, which is not shown in the figure, is formed by the same nozzles as the second raster line.

Since the printer driver knows in advance the number of the nozzles forming a predetermined raster line, it calculates a correction amount for each raster line, based on the characteristic value (see S203) of each nozzle received from the printer. In the present embodiment, the average value of the characteristic values of the nozzles forming a raster line is used as the correction value of that raster line. For example, the correction value of the first raster line is the average value "0" of the characteristic value "+1.0" of the nozzle #11 and the characteristic value "−1.0" of the nozzle #6. The correction value of the second raster line is calculated in the same way as for the correction value of the first raster line, and is the average value "0.25" of the characteristic value "+0.5" of the nozzle #5 and the characteristic value "0" of the nozzle #10. Thus, the correction values from the first to the fifth raster line are calculated.

It should be noted that in the two-pass overlap mode with twelve nozzles, the carry amount is 5·D, so that raster lines formed by the same nozzles appear every five raster lines. Therefore, it is possible to use the correction values of the already-calculated first to fifth raster lines as the correction values of the sixth and further raster lines.

Since the actual number of nozzles is 180, the carry amount for the two-pass overlap mode is 89·D. Therefore, the correction values of each of the first to eighty-ninth raster lines are calculated, and are then used as the correction values of the ninetieth and further raster lines as well.

Figure 25:
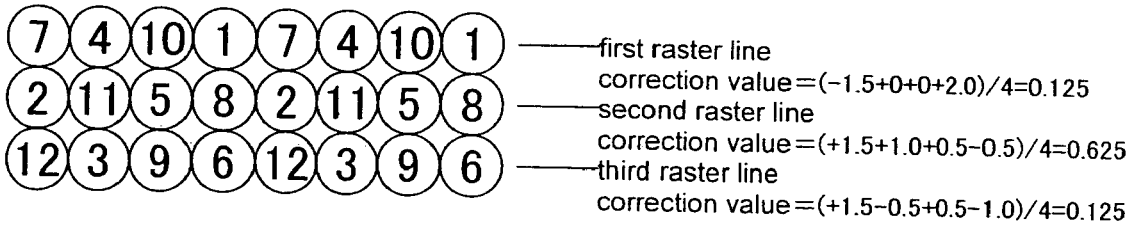
FIG. 25 is an explanatory diagram showing how dots are formed in the case of the four-pass overlap mode with twelve nozzles.

FIG. 25 is an explanatory diagram showing how dots are formed in the case of the four-pass overlap mode with twelve nozzles. In the four-pass overlap mode, the first raster line is formed by the nozzle #10, the nozzle #7, the nozzle #4 and the nozzle #1. Thus, the correction value of the first raster line in the four-pass overlap mode is calculated to be 0.125. Thus, the correction values for the first through the third raster lines are calculated. It should be noted that in this overlap mode using twelve nozzles, the carry amount is 3·D, so that raster lines formed by the same nozzles appear every three raster lines. Therefore, it is possible to use the correction values of the already-calculated first to third raster lines as the correction values of the fourth and further raster lines as well.

Since the actual number of nozzles is 180, the carry amount for the four-pass overlap mode is 45·D. Therefore, the correction values of each of the first to forty-fifth raster lines are calculated, and are then used as the correction values of the forty-sixth and further raster lines as well.

<S205: Regarding the Creation of Print Data>If the correction value of a raster line is "1.0" for example, then this raster line will be formed by nozzles having an average characteristic value of 1.0. Here, a nozzle with a characteristic value of 1.0 forms a pattern with a darkness that is 1% lower than the reference darkness. This means that if a raster line with a correction value of "1.0" is printed by the printer without being corrected, then the ink landing on the paper will spread in the movement direction, the darkness of the pixels lining up in the movement direction will be averaged, and this averaged darkness will be about 1% lighter than the darkness that was indicated by the image data. When a raster line is printed in this manner, then this raster line becomes lighter and a light stripe appears on the printed image, which leads to a deterioration in image quality.

Accordingly, in the present embodiment, if the correction value of the raster line is for example "1.0", then the image data (pixel data) of that raster line is converted into print data that is 1% darker than normal. The following is an explanation of a procedure for this.

Figure 26:
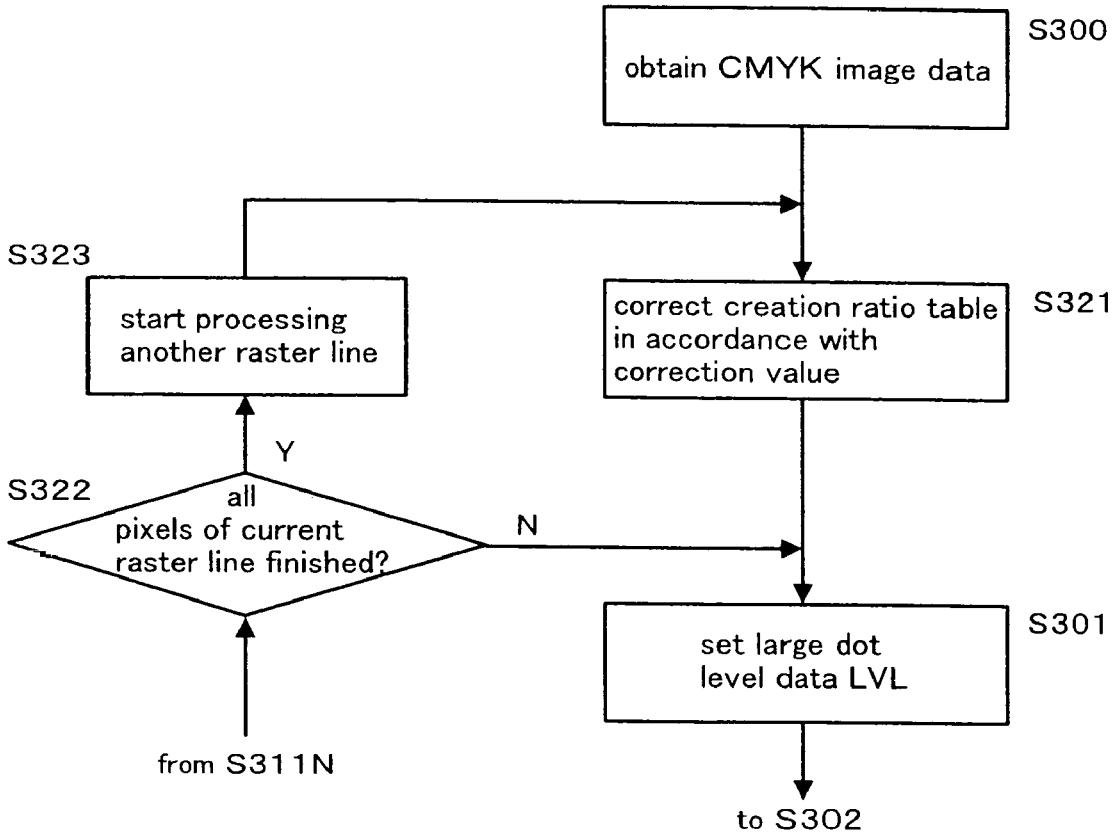
FIG. 26 is an explanatory diagram of the changed portion of the halftone process in FIG. 3.

FIG. 26 is an explanatory diagram of the changed portion of the halftone process in FIG. 3. In the present embodiment, after the above-described Step S300, a Step 321 is added prior to Step S301. Furthermore, in the present embodiment, after judging "No" in Step 311, a Step 322 and a Step 323 have been added. The following is an explanation of these processes, but explanations of steps that already have been explained are omitted.

After the CMYK image data (of 256 gradations) has been received (Step S300), the printer driver starts the processing (halftone processing) of the first pixel data of the first raster line.

First, in Step 321, the printer driver corrects the creation ratio table based on the correction value of the first raster line, to process the pixel data of the first raster line. The printer driver stores the profiles of the creation ratio table shown in FIG. 4 (profile LD, profile MD and profile SD) in form of a one-dimensional table. Accordingly, the printer driver corrects this one-dimensional table in accordance with the correction value of the first raster line.

More specifically, if the correction value of a raster line is "1.0", then the printer driver corrects the creation ratio table such that the profiles of the creation ratio table shown in FIG. 4 are shifted to the left with respect to the gradation values. As a result, compared to the regular creation ratio table, the creation ratio for large dots becomes higher in the corrected creation ratio table. For example, if the gradation value is 192, then the creation ratio for large dots is 50% in the regular creation ratio table, but in a creation ratio table that has been corrected such that the profiles are shifted to the left with respect to the gradation values, the creation ratio for large dots becomes 52%. Also, the larger the absolute value of the correction value is, the more the profiles of the creation ratio table are shifted with respect to the gradation values. If the correction value of a raster line is negative, then the creation ratio table is corrected such that the profiles of the creation ratio table shown in FIG. 4 are shifted to the right with respect to the gradation values.

Then, the processing of Step S301 to Step S311 is performed based on the corrected creation ratio table. In this way, the processing of the first pixel data of the first raster line is finished. Then, the result of the judgment at Step S311 is "No." In the present embodiment, if "No" is judged at Step 311, the procedure advances to Step 322.

At Step 322, it is judged whether or not the processing of all pixel data of that raster line has been finished. At this stage of the explanations, only the processing of the first pixel data of the first raster line has been finished, so that the result is "No."

Then, the printer driver starts to process the next pixel data of the first raster line. The processing of the next pixel data of the first raster line is performed based on the creation ratio table that already has been corrected. That is to say, it is not necessary to correct the creation table again when processing this pixel. The printer driver then processes the next pixel using the same creation ratio table as the one with which the first pixel data was processed. Repeating this process, the processing of the pixel data of the first raster line is finished (until "Yes" is judged at Step 322). When the processing of all of the pixel data of the first raster line is finished, then the processing of the second raster line starts (Step 323).

When the processing of the second raster line starts, the printer driver corrects the creation ratio table based on the correction value of the second raster line.

The further processing is similar to the above. That is to say, when the processing of a new raster line starts, the creation ratio table is corrected based on the correction value, and the processing of all the pixel data of that raster line is performed based on this corrected creation ratio table.

Figure 27:
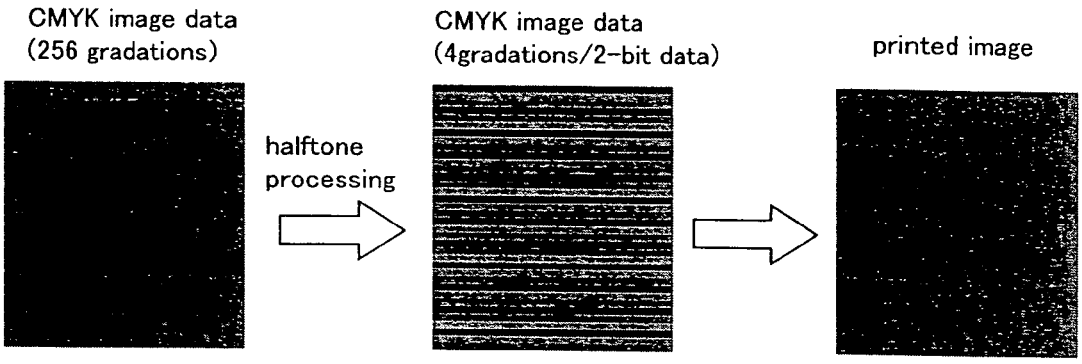
FIG. 27 is an explanatory diagram of the CMYK image data of 256 gradations, the CMYK image data of four gradations, and the printed image, according to the present embodiment.

FIG. 27 is an explanatory diagram of the CMYK image data (CMYK pixel data) of 256 gradations of the present embodiment, the CMYK image data of four gradations (two bits) after halftone processing, and the printed image. Here, to simplify explanations, the image data of 256 gradations is made of pixel data that all has the same gradation, and the image expressed by the image data has a uniform darkness.

If the creation ratio table is not corrected, then the two-bit CMYK image data that has been halftone processed will have a uniform darkness, just like the CMYK image data of the 256 gradations prior to the halftone processing. However, since the ejection characteristics of the individual nozzles differ, the printed image would become an image with stripes along the movement direction (see FIG. 18) if printing were performed without correction.

In the present embodiment, as already noted above, the creation ratio table is corrected. Thus, the two-bit CMYK image data that has been halftone processed becomes an image with stripes in the movement direction. That is to say, in the present embodiment, since the creation ratio table is corrected for each raster line, the same creation ratio table is used for the same raster line, and the two-bit CMYK image data that has been halftone processed has the same darkness at the same raster line. Also, in the present embodiment, since the creation ratio table is corrected for each raster line, a different creation ratio table is used for different raster lines, and the two-bit CMYK image data that has been halftone processed has a different darkness at different raster lines.

If ink were ejected from all nozzles in an ideal manner, then the image printed on the paper would become an image with stripes along the movement direction, like the image expressed by the two-bit CMYK image data that has been halftone processed.

However, in actuality, the ejection characteristics of the individual nozzles differ, so that not all nozzles eject ink in an ideal manner. Furthermore, in the present embodiment, raster lines that are formed by nozzles that eject comparatively much ink are processed into image data of comparatively lower darkness, by correcting the creation ratio table. Moreover, in the present embodiment, raster lines that are formed by nozzles that eject comparatively less ink are processed into image data of comparatively higher darkness, by correcting the creation ratio table.

Thus, if the printer performs the printing based on the two-bit data representing an image with stripes, then a printed image of uniform darkness is printed on the paper. That is to say, with the present embodiment, halftone processing is performed with a creation ratio table that has been corrected so as to cancel the influence of the nozzles' ejection characteristics, so that the image quality of the printed image is improved.

For example, in the second raster line of the two-pass overlap mode, the nozzle #5 ejects ink in an ideal manner (forms dots with the ideal darkness), but the nozzle #10 ejects comparatively little ink (forms dots with a darkness that is 5% lighter than the ideal darkness). For this reason, if the creation ratio table is not corrected, the raster lines formed by these two nozzles would be formed with a darkness that is, overall, 2.5% lighter. Accordingly, in the present embodiment, the image data of the second raster line is converted, with the corrected creation ratio table, into print data with a darkness that is 2.5% darker than normal. Thus, the nozzle #5 forms raster lines that are 2.5% darker than in the uncorrected case. It should be noted that the dots formed by the nozzle #5 (every other dot in the raster line) are thus 2.5% darker than the ideal darkness. Also the nozzle #10 forms raster lines that are 2.5% darker than in the uncorrected case. Thus, the dots formed by the nozzle #10 (every other dot in the raster line) are 2.5% lighter than the ideal darkness. As a result, taken as a whole, the second raster line is printed, as a raster line, with the ideal darkness.

In the above, to simplify explanations, data representing an image of uniform darkness was used as the image data. However, if the process of converting the image data to print data as in the present embodiment is performed, then the stripes in the movement direction are eliminated from the printed image also when printing, for example, a natural image such as a scenic photo, thus improving image quality.

COMPARATIVE EXAMPLES

<Correcting the Creation Ratio Table Pixel by Pixel>

In the foregoing explanations, the creation ratio table was corrected raster line by raster line, and the darkness of the overall raster lines printed on paper was changed to the ideal darkness.

However, since the characteristic value of each nozzle is known, it is also conceivable to correct the creation ratio table pixel for pixel, instead of correcting it raster line for raster line.

For example, in the first raster line of the two-pass overlap mode, the positions of the pixels in which the dots are formed by the nozzle #11 and the pixels in which the dots are formed by the nozzle #6 are known. Accordingly, it is conceivable to process the pixel data of the pixels in which the dots are formed by the nozzle #11 in accordance with a creation ratio table that has been corrected for the characteristic value of the nozzle #11 and to process the pixel data of the pixels in which the dots are formed by the nozzle #6 in accordance with a creation ratio table that has been corrected for the characteristic value of the nozzle #6. However, this increases the number of times that the creation ratio table has to be corrected, so that the calculation time when converting the image data into print data becomes long. By contrast, in the present embodiment, the creation ratio table is corrected raster line by raster line, so that the number of times that the creation ratio table is corrected is reduced, and the calculation time for converting the image data into print data is shortened.

<Correcting the Creation Ratio Table for Each Line in the Carrying Direction>

In the above explanations, the creation ratio table is corrected for each raster line formed in the movement direction.

However, it is also conceivable to correct the creation ratio table for each dot line lined up in the carrying direction.

For example, the first dots on the left side in the four-pass overlap mode are formed by the nozzle #7, the nozzle #2 and the nozzle #12, so that it is conceivable to calculate a correction value from the average values of the characteristic values of these nozzles, to correct the creation ratio table with the calculated correction value, and to process the pixel data of the first pixels on the left side.

However, the image quality of the printed image will be improved more when the dot lines along the movement direction (raster lines) are corrected than when the dot lines along the carrying direction are corrected. The reason for this is that, since the ink is ejected from nozzles that move in the movement direction, the ink landing on the paper tends to spread in the movement direction and the darkness of the pixels lining up in the movement direction is averaged, and thus, the averaged darkness differs from raster line to raster line. It should be noted that the reason why the ink tends to spread in the movement direction is that the dots are formed by ink that is ejected from nozzles that move in the movement direction, so that they have the shape of ellipses with a major axis in the movement direction.

Other Embodiments

The foregoing embodiment described primarily a printer. However, it goes without saying that the foregoing description also includes the disclosure of printing apparatuses, recording apparatuses, liquid ejection apparatuses, printing methods, recording methods, liquid ejection methods, printing systems, recording systems, computer systems, programs, storage media storing programs, display screens, screen display methods, and methods for producing printed material, for example.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes equivalents. In particular, the embodiments mentioned below are also included in the invention.

<Regarding the Correction of Image Data>

With the above-described embodiment, after the color conversion process has been performed, a corrected creation ratio table is used when performing the process of converting the CMYK image data of 256 gradations into CMYK image data of four gradations (halftone processing), thus producing image data (CMYK image data of four gradations) with stripes in the movement direction. However, there is no limitation to performing the conversion process in accordance with the characteristics of the nozzles forming the raster lines at the time of the halftone process. For example, as explained below, it is also possible for the printer driver to perform the conversion process in accordance with the characteristics of the nozzles forming the raster lines prior to the halftone process.

Figure 28:
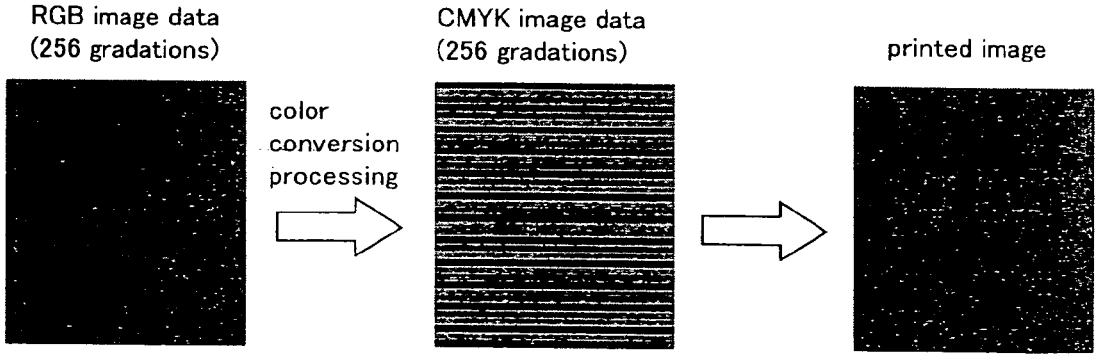
FIG. 28 is an explanatory diagram of a conversion process according to another embodiment.

FIG. 28 is an explanatory diagram of a conversion process according to another embodiment. In this embodiment, the color conversion lookup table LUT is corrected by the correction value in accordance with the characteristics of the nozzles forming the raster lines. As in the above-described embodiment, the correction of the LUT is performed raster line by raster line. Then, using the same LUT for the same raster lines, the printer driver converts the RGB image data of 256 gradations into CMYK image data of 256 gradations. It should be noted that as in the above-described embodiment, due to the correction of the LUT, the raster lines that are formed by nozzles ejecting comparatively more ink are subjected to such a color conversion process that they are turned into CMYK image data of gradations representing comparatively lighter darkness. Also, due to the correction of the LUT, the raster lines that are formed by nozzles that eject comparatively less ink are processed into CMYK image data of gradations representing comparatively higher darkness.

Also in the present embodiment, as in the above-described embodiment, stripes in the movement direction are eliminated from the printed image, thus improving image quality.

It should be noted that the conversion process in accordance with the characteristics of the nozzles forming the raster lines is not limited to the above-described embodiment. For example, it is also possible to correct the gradations of the RGB image data in accordance with the characteristics of the nozzles forming the raster lines (the corrected data is thus RGB image data of 256 gradations). Furthermore, it is also possible to correct the gradations of the CMYK image data in accordance with the characteristics of the nozzles forming the raster lines.

However, it is desirable that the conversion process in accordance with the characteristics of the nozzles forming the raster lines is performed after the resolution conversion process. The reason for this is that the image data after being subjected to the resolution conversion process has the same resolution as the image to be printed, so that it is easy to specify the image data (pixel data) corresponding to a predetermined raster line of the image to be printed.

<Regarding the Printer>

In the above embodiment a printer was described. However, there is no limitation to this. For example, technology like that of the present embodiment can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, methods therefor and manufacturing methods are within the scope of application. Also when applying the present technology to these fields, the fact that liquid can be directly ejected (written) to a target object allows a reduction in material, process steps, and costs compared to conventional cases.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, machining liquid, and genetic solutions. A reduction in material, process steps, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods, such as a method for generating bubbles in the nozzles through heat, may also be employed.

Overview (1) In the foregoing embodiment, a printing system includes a printer (printing apparatus) provided with a plurality of nozzles that can move in a movement direction, and a computer (control apparatus) that converts image data into print data. Moreover, the printer forms dots on a paper (medium) by ejecting ink from the moving nozzles in accordance with the print data, raster lines (dot lines) are constituted by a plurality of dots lining up in the movement direction, and a print image is printed on the paper by a plurality of those raster lines.

The nozzles of the printer of this printing system have different ink ejection characteristics, due to manufacturing discrepancies and other influences. Due to the individual differences in the ink ejection characteristics, the image quality of print images printed on paper is degraded.

To address this problem, since the positions of the pixels in which the nozzles form dots are known, it is conceivable to convert the pixel data of each pixel into print data in accordance with the characteristics of the nozzle ejecting ink onto that pixel. For example, it is conceivable to convert the pixel data of the pixels in which dots are formed by the nozzles with a low ink ejection amount into print data expressing a higher darkness. In this way, the darkness of the image printed on paper would approach the darkness expressed by the original image data, thus improving the image quality.

However, if the image data is converted into print data while performing correction for each pixel data in accordance with the nozzles characteristics, then the calculation load of the conversion process becomes large, and the generation of the print data takes a lot of time, thereby decreasing the printing speed.

Accordingly, in the above-described embodiment, the characteristic values for each nozzle is stored at first. Then, when a raster line is formed by at least two nozzles, the computer (the printer driver installed on the computer) calculates a correction value based on the at least two characteristic values corresponding to the at least two nozzles forming that dot line, and the image data corresponding to this dot line is converted into print data in accordance with this correction value.

In this way, the overall darkness of a given raster line is corrected in accordance with the characteristic values of the nozzles forming that raster line, and it thus approaches the darkness expressed by the initial image data. As a result, stripes appearing in the printed image are eliminated, and the image quality of the printed image is improved.

Furthermore, in this embodiment, the same correction value is used for the same raster line, so that the calculation load becomes small when image data is converted into print data. As a result, the computer (the computer on which the printer driver is installed) can generate the print data fast, and the printing speed of the printing system can be accelerated.

(2) In the above-described embodiment, when the computer (control apparatus) on which the printer driver is installed converts the image data into print data, a halftone process is performed in which CMYK image data of 256 gradations (multi-gradation image data) is converted into CMYK image data of four gradations (image data having a lower number of gradations than the multi-gradation image data). Moreover, this computer performs a halftone process in accordance with a correction value (the correction value that has been calculated in accordance with the at least two characteristic values corresponding to the at least two nozzles forming the raster line).

Thus, the CMYK image data of four gradations that has been halftone processed comes to represent an image having stripes along the movement direction. However, when this CMYK image data of four gradations is printed with a printer, it is subject to the influence of the ejection characteristics of the nozzles, so that no stripes appear in the image printed on paper. As a result, the image quality of the printed image is improved.

(3) In the above-described embodiment, the computer (control apparatus) on which the printer driver is installed corrects the creation ratio table for determining the creation ratio of dots in accordance with the correction value (the correction value that has been calculated in accordance with the at least two characteristic values corresponding to the at least two nozzles forming the raster line), and the halftone process is performed in accordance with the corrected creation ratio table.

For example, if a correction value is positive, then the creation ratio table is corrected such that the profiles of the creation ratio table in FIG. 4 are shifted to the left with respect to the gradation values. Also, if the absolute value of the correction value is large, then the creation ratio table is corrected such that the profiles of the creation ratio table in FIG. 4 are shifted by a large amount.

Thus, since the creation ratio table is corrected in accordance with the ejection characteristics of the nozzles forming the raster lines, the CMYK image data of four gradations that have been halftone processed becomes image data in expectation of the influence of the ejection characteristics of the nozzles.

(4) In the above-described embodiment, the printing system expresses the darkness of the printed image within a predetermined region with the ink amount that is ejected onto a plurality of pixels within that region. For example, the number of dots formed in 16×16=256 pixels express the darkness of the printed image in this region of 16×16 squares. Moreover, in the above-described embodiment, the ink amount that is ejected onto a plurality of pixels is corrected in accordance with the nozzle ejection characteristics.

More specifically, the number of dots (the number of large dots, medium dots and small dots) formed in these 16×16=256 pixels changes depending on the correction values derived from the nozzle ejection characteristics. As a result, the darkness of the print image in this region approaches the darkness expressed by the initial image data.

If the ink amount ejected from one pixel were corrected in accordance with the nozzle ejection characteristics, then that nozzle would have to eject ink drops of various ink amounts, making the configuration of the nozzles more complicated.

By contrast, with the above-described embodiment, it is possible to decrease the number of gradations to be expressed by each nozzle (for example, to only four gradations), so that the configuration of the nozzles can be simplified, and the apparatus can be provided at low cost.

(5) In the above-described embodiment, dithering is used for the halftone process. This expresses the darkness of the printed image within a predetermined region including a plurality of pixels.

However, the method of the halftone process is not limited to dithering. For example, it is also possible to use γ-correction or error diffusion or the like.

(6) In the above-described embodiment, when the computer (control apparatus) on which the printer driver is installed converts the image data into print data, a color conversion process is performed to convert the RGB image data (image data in RGB color space) into CMYK image data (image data in CMYK color space). Moreover, in the above-described embodiment, this computer performs a color conversion process in accordance with the correction value (the correction value that has been calculated in accordance with the at least two characteristic values corresponding to the at least two nozzles forming the raster line).

Thus, the CMYK image data of 256 gradations that has been color converted comes to represent an image having stripes along the movement direction. However, when the CMYK image data of 256 gradations is printed with a printer, it is subject to the influence of the ejection characteristics of the nozzles, so that no stripes appear in the image printed on paper. As a result, the image quality of the printed image is improved.

(7) In the above-described embodiment, the computer (control apparatus) on which the printer driver is installed corrects the color conversion lookup table LUT (color conversion table) in accordance with the correction value (the correction values that has been calculated in accordance with the at least two characteristic values corresponding to the at least two nozzles forming the raster line), and the color conversion process is performed in accordance with the corrected LUT.

For example, due to the correction of the LUT, the raster lines that are formed by nozzles that eject comparatively much ink are color converted into CMYK image data of gradations representing comparatively lower darkness.

Thus, since the LUT is corrected in accordance with the ejection characteristics of the nozzles forming the raster lines, the CMYK image data of 256 gradations that has been color converted becomes image data in expectation of the influence of the ejection characteristics of the nozzles.

(8) In the above-described embodiment, the computer (control apparatus) on which the printer driver is installed performs a resolution conversion process when converting the image data into print data. Moreover, in the above-described embodiment, the calculation of the correction value (the correction value that is calculated in accordance with the at least two characteristic values corresponding to the at least two nozzles forming the raster line) is performed after the resolution conversion process.

Since the image data after the resolution conversion process has the same resolution as the print resolution, it is easy to specify the image data (pixel data) corresponding to predetermined raster lines of the printed image.

(9) In the above-described embodiment, the printer (printing apparatus) has a memory for storing the characteristic values corresponding to the nozzles. Also, the printer (printing apparatus) sends information about the characteristic values to the computer (control apparatus) on which the printer driver is installed.

The characteristic values corresponding to the nozzles differ from printer to printer, so that it is difficult to store them with the printer driver when shipping the printer. Therefore, it is preferable that the characteristic values corresponding to the nozzles are stored in a memory of the printer. However, when the printer driver converts the image data into print data, it is necessary to let the printer driver know the characteristic values.

Accordingly, the printer sends the information regarding the characteristic values corresponding to the nozzles to the computer. Thus, when the printer driver converts the image data into print data, the characteristic values corresponding to the nozzles can be utilized.

(10) In the above-described embodiments, the computer (control apparatus) on which the printer driver is installed determines the nozzles that form the raster lines (dot lines) in accordance with the print mode.

For example, in the case of the "two-pass overlap mode," it determines that the nozzle #11 and the nozzle #6 form the first raster line. And in the case of the "two-pass overlap mode," it is also determined for the other raster lines by which nozzles they are formed. On the other hand, in the "four-pass overlap mode", it is determined that the first raster line is formed by the nozzle #7, the nozzle #4, the nozzle #10 and the nozzle #1. And in the case of the "four-pass overlap mode," it is also determined for the other raster lines by which nozzles they are formed.

Thus, if the print mode is determined, then the nozzles that form a raster line can be determined. It should be noted that the print mode is determined in accordance with settings made by the user through the user interface of the printer driver.

(11) In the above-described embodiment, the printer (printing apparatus) can print a test pattern for inspecting the ejection characteristics of the nozzles.

For example, as shown in FIG. 22, the printer can print a test pattern having block patterns each made of dots formed by a specific nozzle. Therefore, by inspecting the darkness of these block patterns, the ejection characteristics of the nozzles that have formed these block patterns can be inspected.

However, the test pattern is not limited to such a block pattern.

For example, it also may be a test pattern formed by the interlaced mode. Then, if the darkness of each of the raster lines is detected by reading in the image of the test pattern with a scanner, then the ejection characteristics of the nozzles that have formed that raster line can be inspected.

(12) In the above-described embodiment, the printing system stores the characteristic value of each nozzle in accordance with the result of inspecting the test pattern.

For example, the darkness of each block pattern shown in FIG. 22 is detected, the characteristic values of the nozzles that have formed these block patterns are determined based on the darkness of the detected block patterns, and the characteristic values of the nozzles are stored.

Thus, the characteristic value of each nozzle can be determined.

(13) In the above-described embodiment, the dots have the shape of ellipses with a major axis in the movement direction. This is because the dots are formed by ink that is ejected from nozzles that move in the movement direction.

Now, in the above-described embodiment, the correction is calculated based on at least two characteristic values corresponding to the at least two nozzles that form that raster line. And using this correction value, the image data (pixel data) corresponding to this raster line is converted into print data. Thus, in the above-described embodiment, the overall darkness of a given raster line approaches the darkness expressed by the image data. That is to say, in the above-described embodiment, not the darkness of the individual pixels, but the average darkness of the raster lines approaches the darkness expressed by the image data.

Therefore, if the dots have the shape of ellipses with a major axis in the movement direction as in the present embodiment, then the ink tends to spread in the movement direction, and the darkness of pixels that are adjacent in the movement direction is averaged. As a result, if the print data is created using the above-explained correction values, then the overall darkness of the raster lines of the printed image better approaches the darkness expressed by the image data.

If the dots had a circular shape or the shape of ellipses with a minor axis in the movement direction, then the ink would not tend to spread in the movement direction. In that case, even if the print data were created using the above-explained correction values, then the darkness of the individual pixels would not approach the darkness expressed by the image data, so that the raster lines of the printed image would clearly have a grainy look, and the image quality would not be as good as with the above-described embodiment.

(14) In the above-described embodiment, if the nozzles forming the raster lines (dot lines) have the characteristics in which their ink ejection amount is smaller than that of the reference nozzle serving as the reference, then the image data is converted into print data in such a manner that the ejected ink amount becomes larger than when the reference nozzle forms that raster line.

A nozzle with a comparatively low ink ejection amount will form dots (or patterns) that have a lighter darkness than an ordinary nozzle. Therefore, by ejecting a larger amount of ink when this nozzle forms a printed image, a printed image of the same darkness as a printed image formed by an ordinary nozzle can be formed.

(15) It should be noted that if all of the above-noted structural elements are given, then all effects can be achieved, so that a high-performance printing system can be provided.

However, it is not necessarily required that all the aforementioned structural elements are given. That is to say, in is only necessary that, when a raster line is formed by at least two nozzles, the control apparatus calculates a correction value based on the at least two characteristic values corresponding to the at least two nozzles forming that dot line, and converts the image data corresponding to this dot line into print data in accordance with this correction value. With this configuration, the image quality of the printed image can be improved, and the calculation load for converting the image data into print data in accordance with the nozzle characteristics can be decreased.

(16) Moreover, the printer (printing apparatus), which is provided with a plurality of nozzles that can move in the movement direction, converts the image data into print data, forms dots on a medium by ejecting ink from the moving nozzles in accordance with the print data, forms raster lines made of a plurality of dots lining up in the movement direction, and prints the print image on the medium with a plurality of raster lines.

The function of converting the image data into print data does not have to be on the printer driver side (computer side), but may also be provided on the printer side.

In this case, the controller 60 of the printer stores the characteristic values of the corresponding nozzles, and when a raster line (dot line) is formed by at least two nozzles, a correction value is calculated based on the at least two characteristics values corresponding to the at least two nozzles forming this raster line, and the image data corresponding to this dot line are converted into print data in accordance with this correction value.

Thus, the image quality of the printed image can be improved, and the calculation load for converting the image data into print data in accordance with the nozzle characteristics can be decreased.

(17) Also, the computer (control apparatus) on which the printer driver is installed sends the print data to the printer (printing apparatus) in such a manner that raster lines (dot lines) formed by a plurality of dots lining up in the movement direction by the plurality of nozzles moving in the movement direction are formed on the paper (medium).

With such a computer, it is desired that the print data is created in such a manner that the printer can print the printed image with high image quality. Furthermore, with such a computer, it is desired that the processing speed for converting the image data into print data is fast.

Accordingly, the computer on which the above-described printer driver is installed stores the characteristic values of the corresponding nozzles, and when a raster line (dot line) is formed by at least two nozzles, a correction value is calculated based on the at least two characteristic values corresponding to the at least two nozzles forming this raster line, and the image data corresponding to this raster line is converted into print data in accordance with this correction value.

Thus, the image quality of the printed image can be improved, and the calculation load for converting the image data into print data in accordance with the nozzle characteristics can be decreased.

(18) Also, the printer driver (program) makes the computer (print-control apparatus) that controls the printer (printing apparatus) achieve a function of converting the image data into print data such that dot lines made of a plurality of dots lined up in the movement direction by a plurality of nozzles moving in the movement direction are formed on a medium.

With such a printer driver, it is desired that the print data is created in such a manner that the printer can print the printed image with high image quality. Furthermore, with such a program, it is desired that the processing speed for converting the image data into print data is fast.

Accordingly, the above-described printer driver (program) makes a computer achieve: the function of storing the characteristic values corresponding to the nozzles, the function of calculating a correction value based on the at least two characteristic values corresponding to the at least two nozzles forming this raster line (dot line) when the printer is made to form that dot line with at least two nozzles, and the function of converting the image data corresponding to this dot line into print data in accordance with this correction value.

Thus, the image quality of the printed image can be improved, and the calculation load for converting the image data into print data in accordance with the nozzle characteristics can be decreased.

(19) There is also a printing method that converts the image data into print data, ejects ink from a plurality of nozzles that can move in the movement direction, forms raster lines (dot lines) made up of a plurality of dots lining up in the movement direction, and prints a print image made up of a plurality of raster lines on a paper (medium). With such a printing method, it is desired that the print data is created in such a manner that the printer can print the printed image with high image quality. Furthermore, with such a printing method, it is desired that the processing speed for converting the image data into print data is fast.

Accordingly, with the above-described printing method, the characteristic values of the corresponding nozzles are stored, and when a raster line is formed by at least two nozzles, a correction value is calculated based on the at least two characteristic values corresponding to the at least two nozzles forming this dot line, and the image data corresponding to this dot line is converted into print data in accordance with this correction value.

Thus, the image quality of the printed image can be improved, and the calculation load for converting the image data into print data in accordance with the nozzle characteristics can be reduced.

What is claimed is:

1. A printing method for printing on a medium an image constituted by a plurality of dot lines, said method comprising the following steps of:

storing characteristic values, each corresponding to different nozzles;

calculating a correction value based on at least two of said characteristic values which correspond to at least two of said nozzles that form a given dot line;

converting image data corresponding to the dot line into print data in accordance with said correction value; and forming said dot line with said at least two nozzles by ejecting ink in accordance with said print data from said nozzles which move in a movement direction.

2. A printing method according to claim 1, wherein a halftone process is performed in accordance with said correction value, and in said halftone process, multi-gradation image data is converted into image data having a lower number of gradations than said multi-gradation image data when converting said image data into said print data.

3. A printing method according to claim 2, wherein a creation ratio table for determining a creation ratio of dots is corrected in accordance with said correction value; and wherein said halftone process is performed in accordance with the corrected creation ratio table.

4. A printing method according to claim 2, wherein an amount of ink that is ejected into a plurality of pixels within a predetermined region expresses a darkness of the image in said region.

5. A printing method according to claim 4, wherein dithering is used for said halftone process.

6. A printing method according to claim 1, wherein a color conversion process is performed in accordance with said correction value, and in said color conversion process, image data in the RGB color space is converted into image data in the CMYK color space when converting said image data into said print data.

7. A printing method according to claim 6, wherein a color conversion table for converting said image data in the RGB color space into said image data in the CMYK color space is corrected in accordance with said correction value; and said color conversion process is performed in accordance with the corrected color conversion table.

8. A printing method according to claim 1, wherein a resolution conversion process is performed when converting said image data into said print data, and the calculation of said correction value is carried out after said resolution conversion process.

9. A printing method according to claim 1, wherein information regarding said characteristic values that are stored in a printing apparatus are sent to a control apparatus that converts said image data into said print data.

10. A printing method according to claim 1, wherein the nozzles that form said dot line are determined in accordance with a print mode.

11. A printing method according to claim 1, wherein a test pattern for inspecting ejection characteristics of said nozzles is printed.

12. A printing method according to claim 11, wherein said characteristic values of said nozzles are stored in accordance with the result of inspecting said test pattern.

13. A printing method according to claim 1, wherein the dots constituting said dot line each has a shape of an ellipse with a major axis in said movement direction.

14. A printing method according to claim 1, wherein, if one of the nozzles that form said dot line has a characteristic of ejecting a smaller amount of ink than a reference nozzle serving as a reference, then said image data is converted into said print data such that the amount of ink that is ejected from that nozzle when forming said dot line becomes larger than the amount of ink that is ejected from said reference nozzle when forming said dot line.

15. A printing method for printing on a medium an image constituted by a plurality of dot lines, said method comprising the following steps of:

storing characteristic values, each corresponding to different nozzles;

calculating a correction value based on at least two of said characteristic values which correspond to at least two of said nozzles that form a given dot line;

converting image data corresponding to the dot line into print data in accordance with said correction value; and forming said dot line with said at least two nozzles by ejecting ink in accordance with said print data from said nozzles which move in a movement direction;

wherein a creation ratio table for determining a creation ratio of dots is corrected in accordance with said correction value; a halftone process is performed in accordance with the corrected creation ratio table; and in said halftone process, multi-gradation image data is converted into image data having a lower number of gradations than said multi-gradation image data when converting said image data into said print data;

wherein an amount of ink that is ejected into a plurality of pixels within a predetermined region expresses a darkness of the image in said region;

wherein dithering is used for said halftone process;

wherein a resolution conversion process is performed when converting said image data into said print data, and the calculation of said correction value is carried out after said resolution conversion process;

wherein information regarding said characteristic values that are stored in a printing apparatus are sent to a control apparatus that converts said image data into said print data;

wherein the nozzles that form said dot line are determined in accordance with a print mode;

wherein a test pattern for inspecting ejection characteristics of said nozzles is printed;

wherein said characteristic values of said nozzles are stored in accordance with the result of inspecting said test pattern;

wherein the dots each has a shape of an ellipse with a major axis in said movement direction; and wherein, if one of the nozzles that form said dot line has a characteristic of ejecting a smaller amount of ink than a reference nozzle serving as a reference, then said image data is converted into said print data such that the amount of ink that is ejected from that nozzle when forming said dot line becomes larger than the amount of ink that is ejected from said reference nozzle when forming said dot line.

16. A printing system comprising:

a control apparatus that converts image data into print data; and a printing apparatus that has a plurality of nozzles that are movable in a movement direction, and that prints on a medium an image constituted by a plurality of dot lines by ejecting ink from said plurality of nozzles in accordance with said print data;

wherein said printing apparatus stores characteristic values each corresponding to the respective nozzles;

wherein said control apparatus calculates a correction value based on at least two of said characteristic values which correspond to at least two of said nozzles that form a given dot line;

wherein said control apparatus converts the image data corresponding to the dot line into print data in accordance with said correction value; and wherein said printing apparatus forms said dot line with said at least two nozzles by ejecting ink from said nozzles, which move in said movement direction, in accordance with said print data.

17. A printing apparatus for printing on a medium an image constituted by a plurality of dot lines, said printing apparatus comprising:

a plurality of nozzles that are movable in a movement direction;

a memory that stores characteristic values each corresponding to the respective nozzles; and a controller that calculates a correction value based on at least two of said characteristic values which correspond to at least two of said nozzles that form a given dot line;

converts image data corresponding to the dot line into print data in accordance with said correction value; and forms said dot line with said at least two nozzles by causing ink to be ejected in accordance with said print data from said nozzles which move in said movement direction.

18. A print-control method for controlling a printing apparatus that prints on a medium an image constituted by a plurality of dot lines, said method comprising:

storing characteristic values, each corresponding to different nozzles;

calculating a correction value based on at least two of said characteristic values which correspond to at least two of said nozzles that form a given dot line;

converting image data corresponding to the dot line into print data in accordance with said correction value; and sending said print data to said printing apparatus and causing said dot line to be formed with said at least two nozzles by causing ink to be ejected in accordance with said print data from said nozzles which move in a movement direction.

19. A computer-readable storage medium comprising:

a memory for storing a program, said program causing a print-control apparatus for controlling a printing apparatus that prints on a medium an image constituted by a plurality of dot lines, to:

store characteristic values, each corresponding to different nozzles;

calculate a correction value based on at least two of said characteristic values which correspond to at least two of said nozzles that form a given dot line;

convert image data corresponding to the dot line into print data in accordance with said correction value; and send said print data to said printing apparatus to cause said printing apparatus to form said dot line with said at least two nozzles by ejecting ink in accordance with said print data from said nozzles which move in a movement direction.

* * * * *